United States Patent [19]

Schwarz

[11] Patent Number: 4,907,817

[45] Date of Patent: Mar. 13, 1990

[54] BINDING FOR CROSS-COUNTRY SKI

[75] Inventor: Gunter Schwarz, Au, Switzerland

[73] Assignee: Salomon S.A., Annecy Cedex, France

[21] Appl. No.: 143,851

[22] PCT Filed: Apr. 21, 1987

[86] PCT No.: PCT/CH87/00046

§ 371 Date: Dec. 15, 1987

§ 102(e) Date: Dec. 15, 1987

[87] PCT Pub. No.: WO87/06486

PCT Pub. Date: Nov. 5, 1987

[30] Foreign Application Priority Data

| | | | |
|---|---|---|---|
| Apr. 30, 1986 | [CH] | Switzerland | 1765/86 |
| Nov. 4, 1986 | [CH] | Switzerland | 4371/86 |
| Nov. 5, 1986 | [CH] | Switzerland | 4406/86 |

[51] Int. Cl.[4] ..... A63C 9/20

[52] U.S. Cl. ..... 280/615

[58] Field of Search ..... 280/615, 614, 613

[56] References Cited

U.S. PATENT DOCUMENTS

| | | | |
|---|---|---|---|
| 4,309,833 | 1/1982 | Salomon | 280/615 X |
| 4,382,611 | 5/1983 | Salomon | 280/615 |
| 4,484,762 | 11/1984 | Salomon | 280/615 |
| 4,496,169 | 1/1985 | Salomon et al. | 280/615 |
| 4,562,653 | 1/1986 | Salomon | 280/615 X |

*Primary Examiner*—Kenneth R. Rice
*Assistant Examiner*—Tamara L. Finlay
*Attorney, Agent, or Firm*—Ladas & Parry

[57] ABSTRACT

The cross-country ski binding is provided with two pins (3, 4) which are arranged with their corresponding rigid pin recesses (5, 6) one behind the other in the longitudinal direction of the ski; at least one pin is spring-loaded in a perpendicular direction to the ski by a spring element (2) in the form of a binding arm. In this way, the design is maintained flat and the spring travel is long and spring fore can be optimally adjusted. Insertion of the foot in the binding is also facilitated and the stability of the ski boot (9) around its vertical axis is good and the binding grips without and play. With this design numerous advantageous embodiments of the biding are possible.

28 Claims, 26 Drawing Sheets

Figure 5:
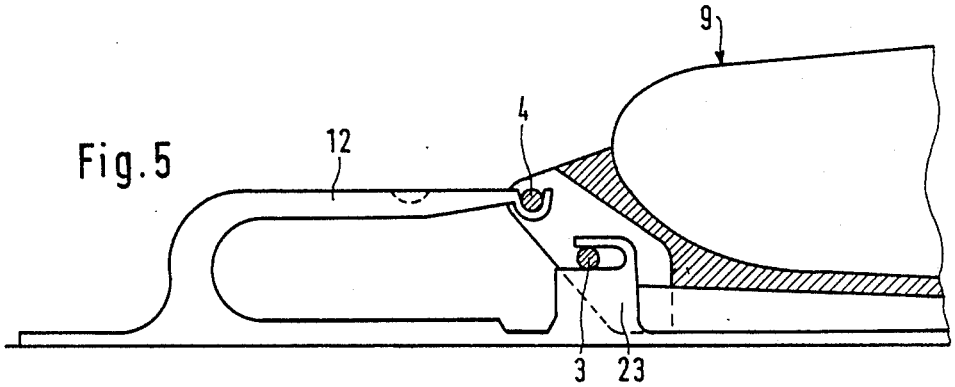

Fig.1
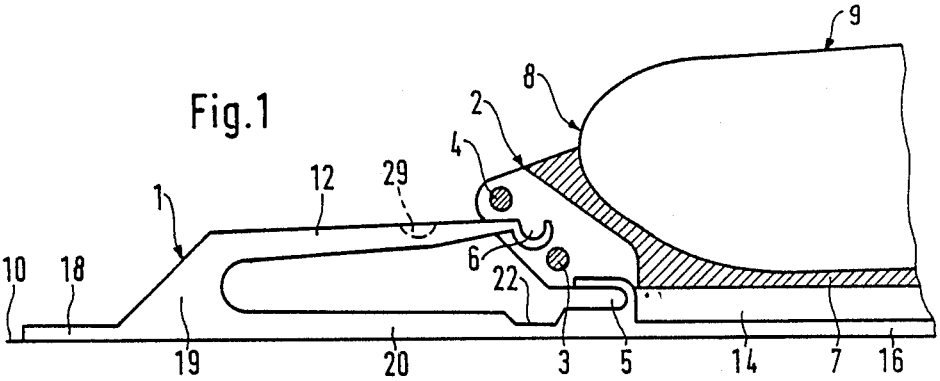
Fig.2
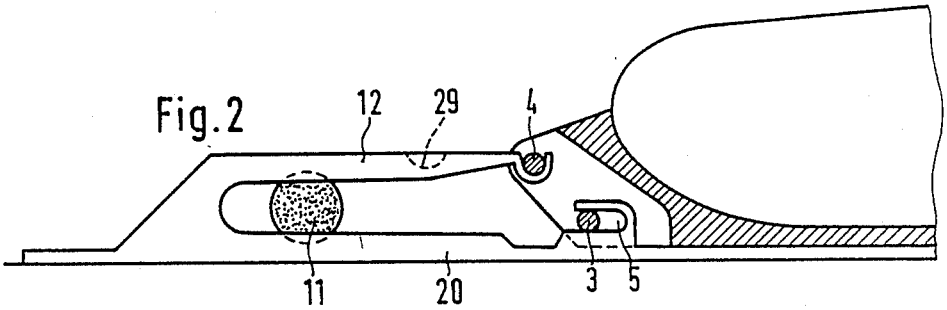
Fig.3
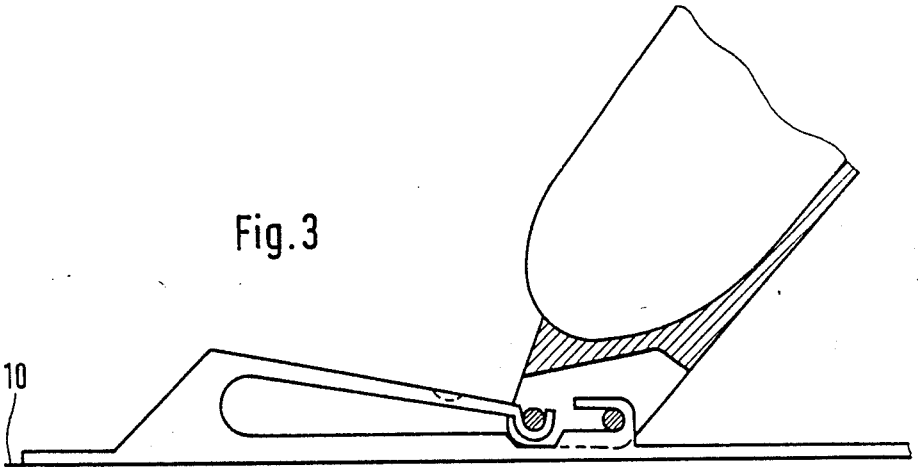
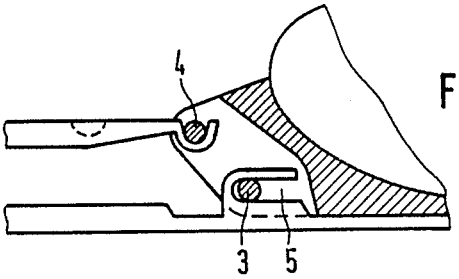
Fig.4

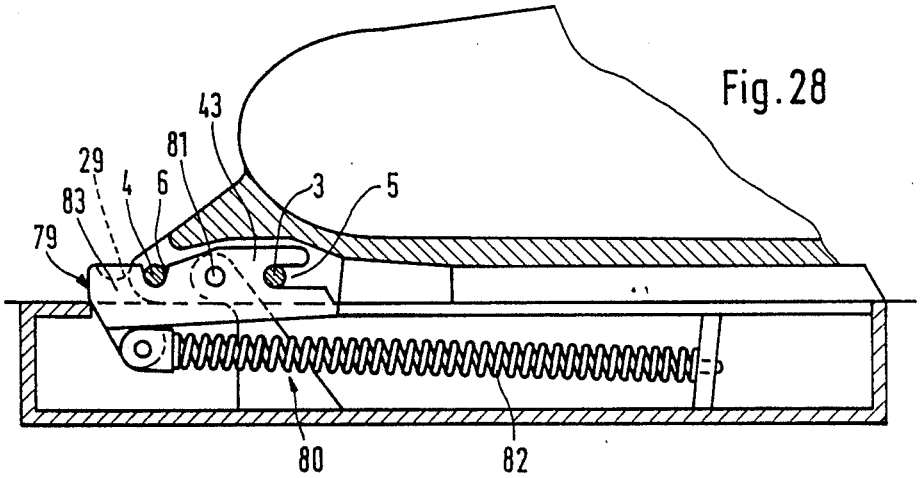
Fig. 28
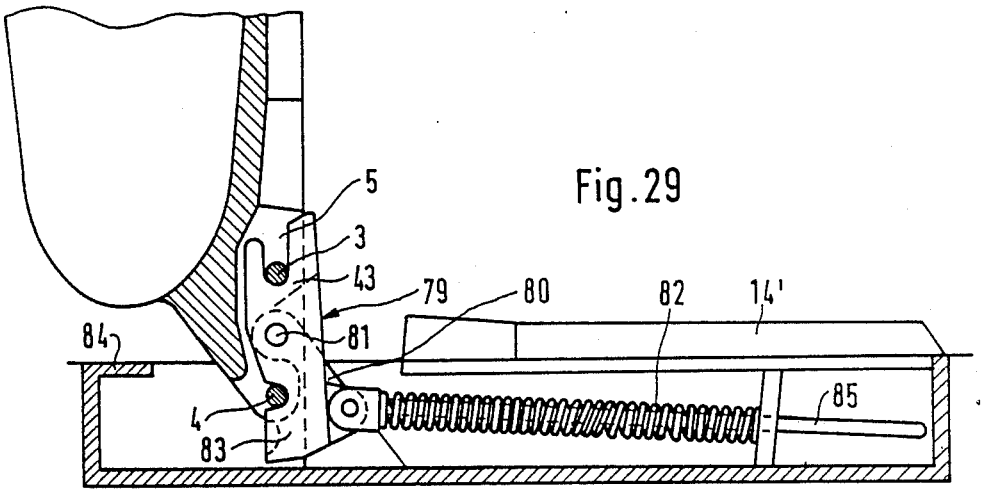
Fig. 29
Fig. 31
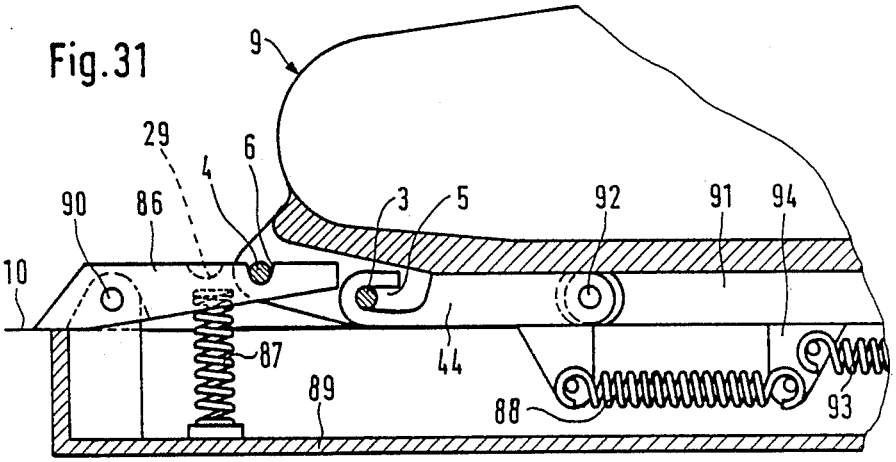

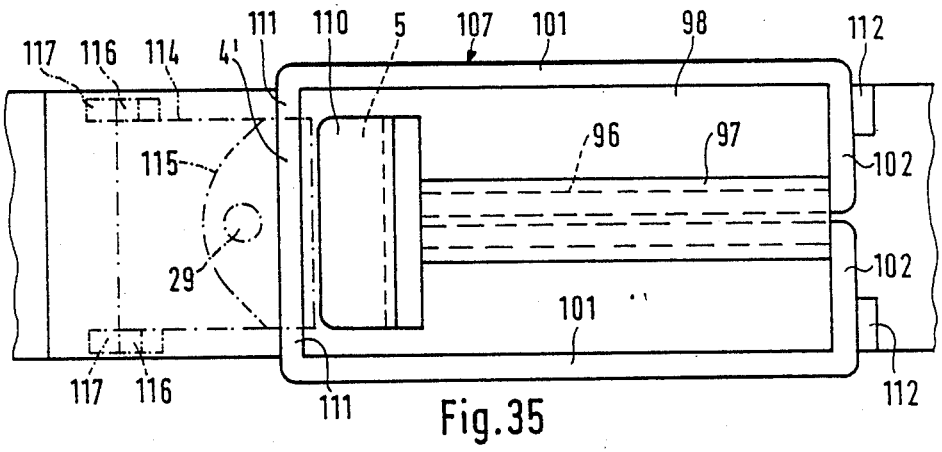
Fig.35
Fig.36
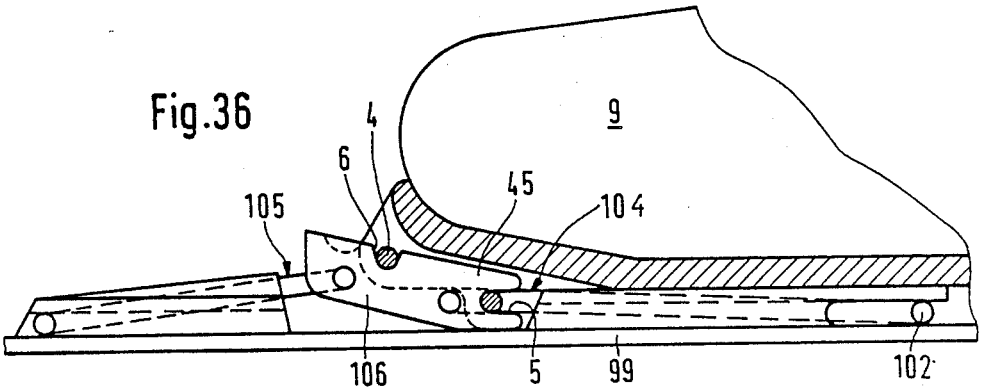
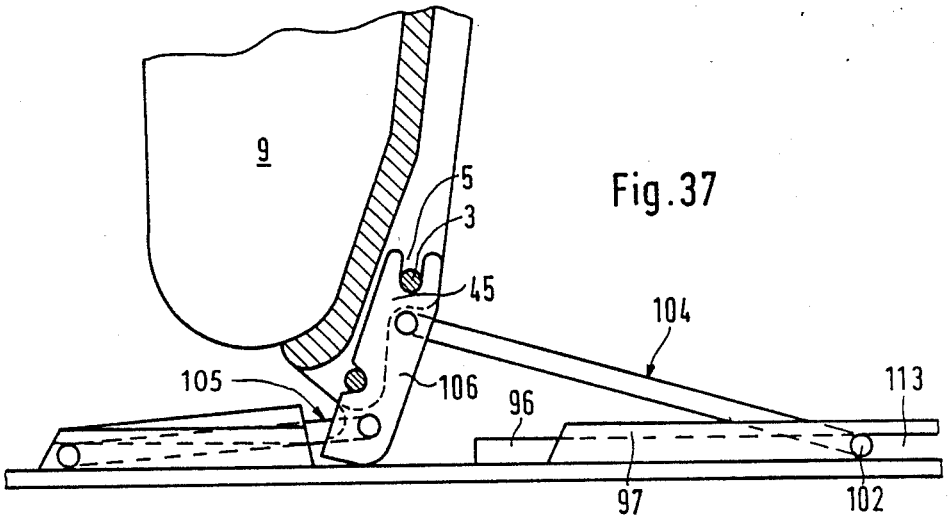
Fig.37

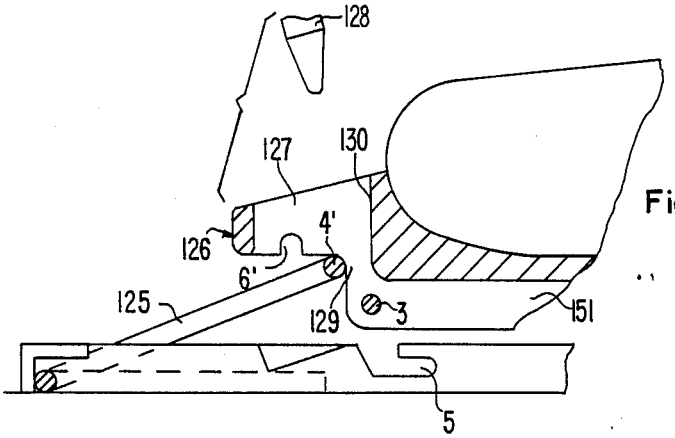
Fig.42
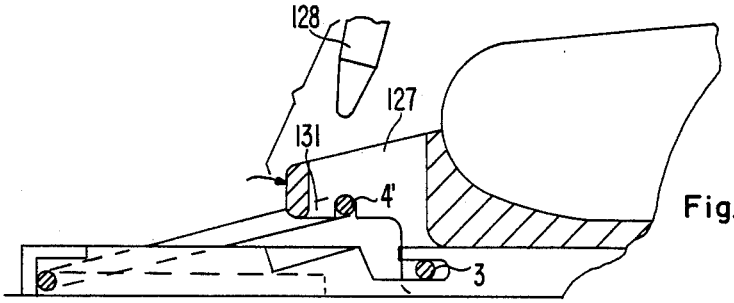
Fig.43
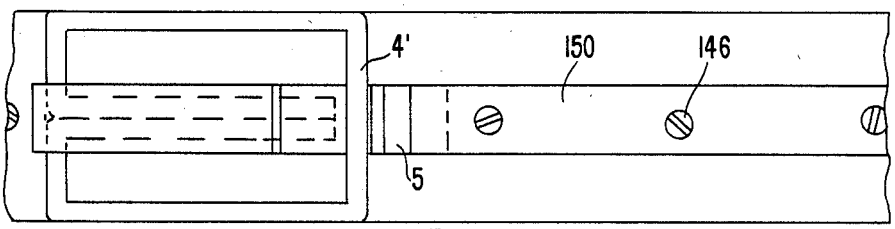
Fig.44
Fig.49
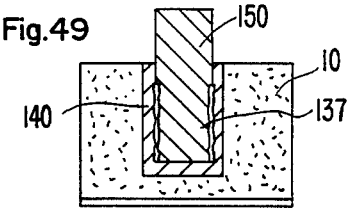
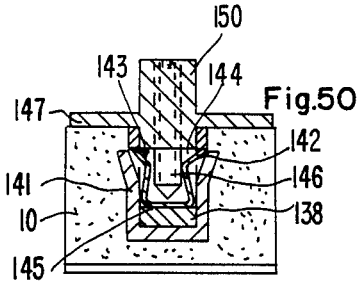
Fig.50

Fig.45
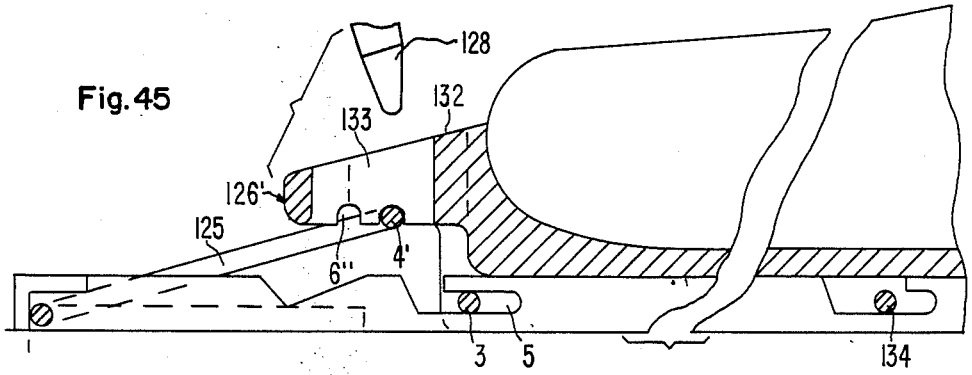
Fig.46
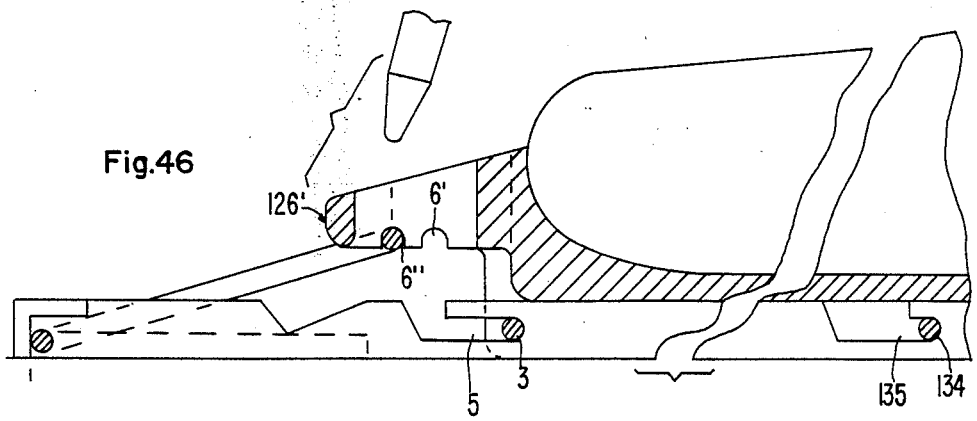
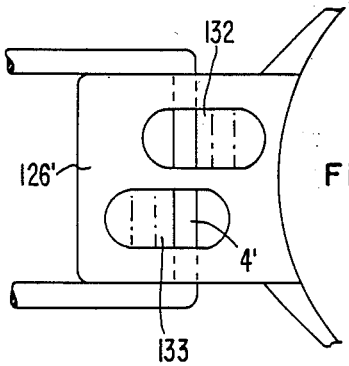
Fig.48
Fig.47
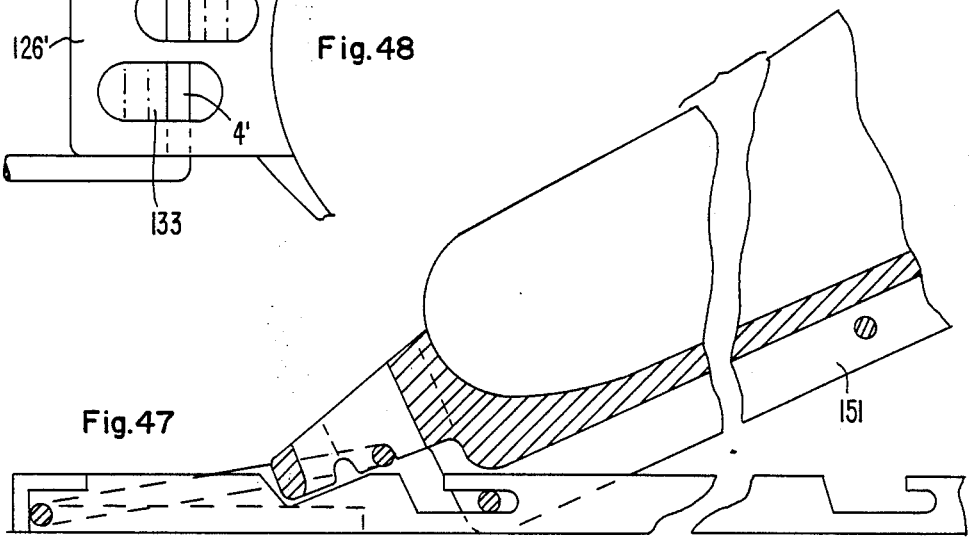

Fig.59
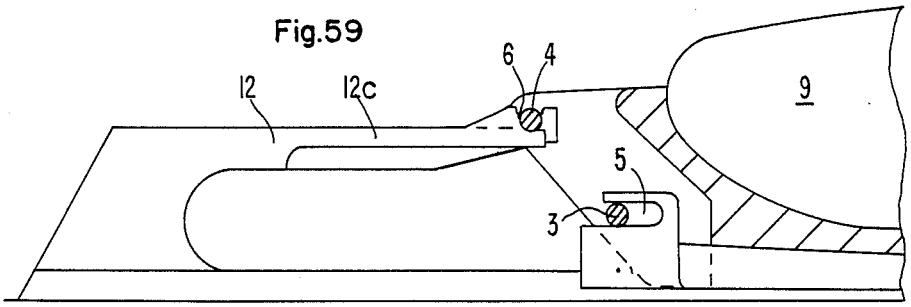
Fig.60
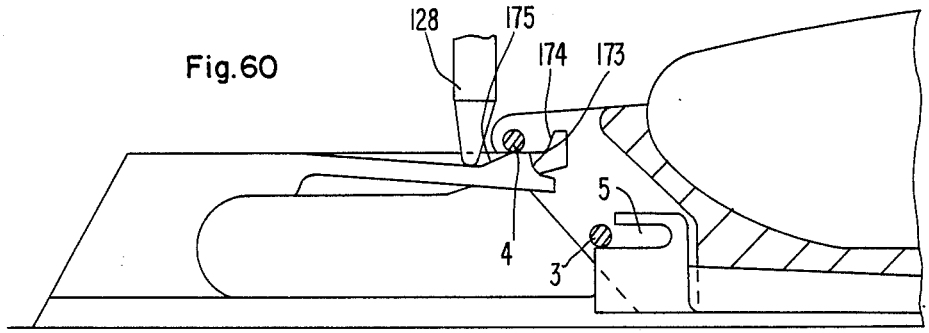
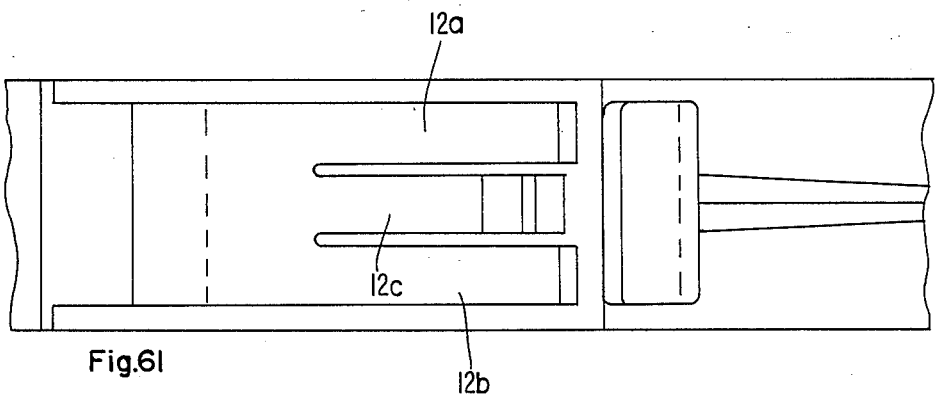
Fig.61

Fig.68
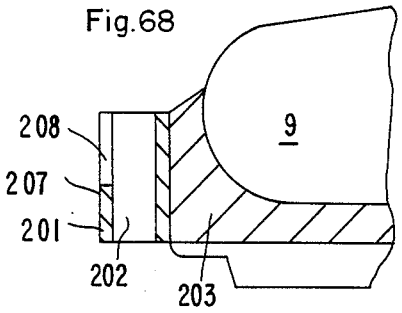
Fig.69
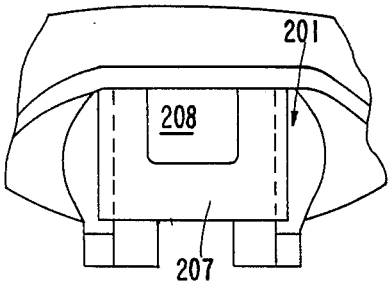
Fig.70
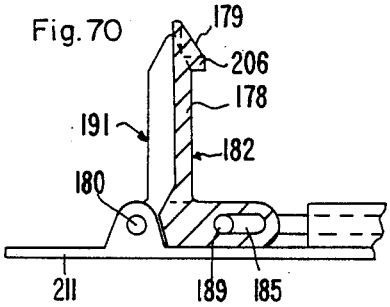
Fig.71
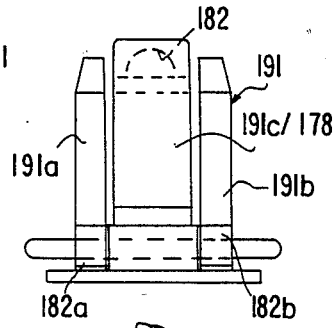
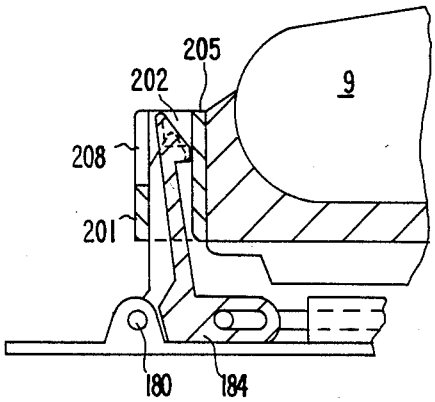
Fig.72
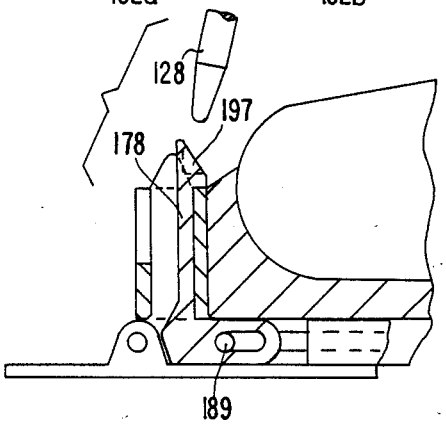
Fig. 73

Fig. 66
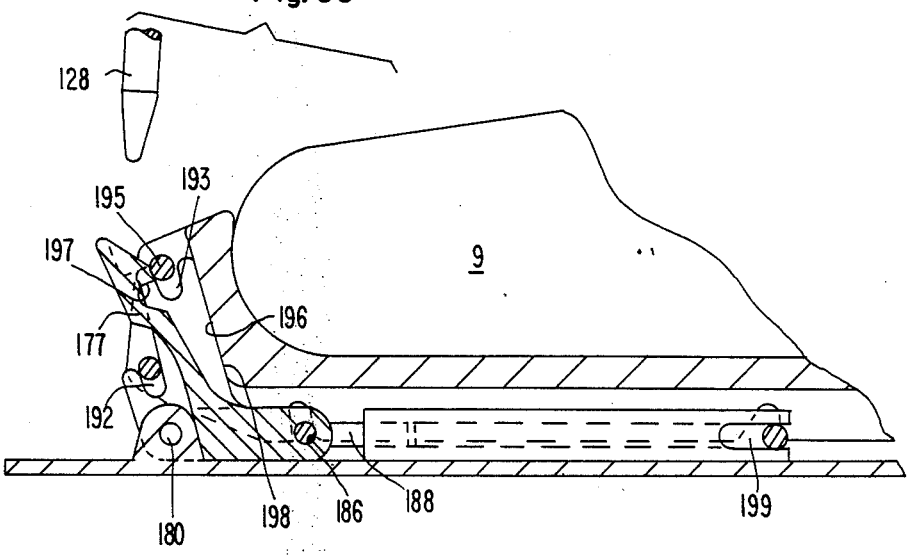
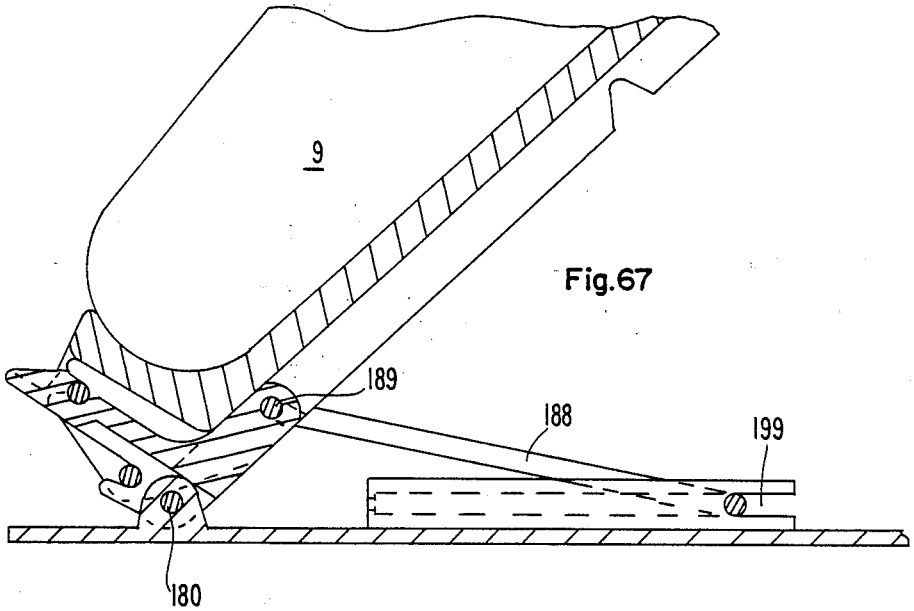
Fig.67

Fig.74
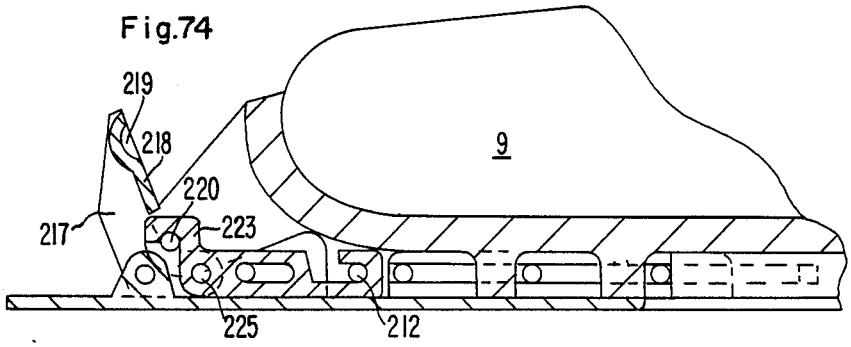
Fig.75
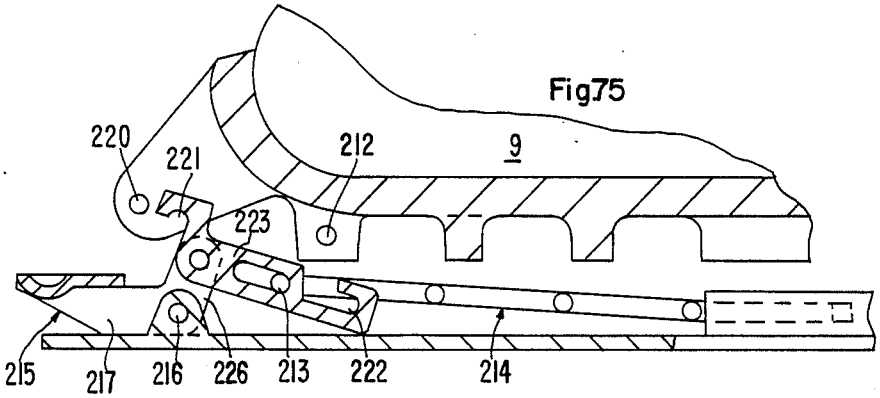
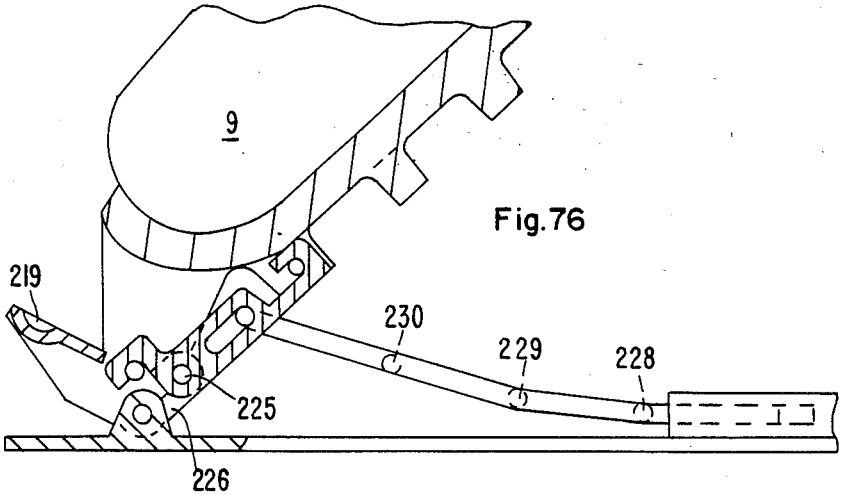
Fig.76

Fig.81
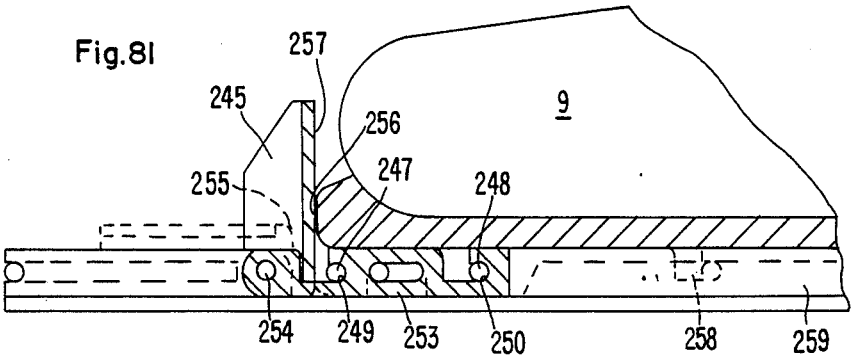
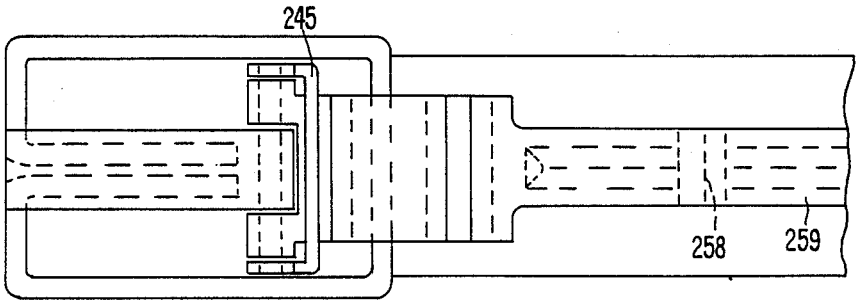
Fig.83
Fig.82
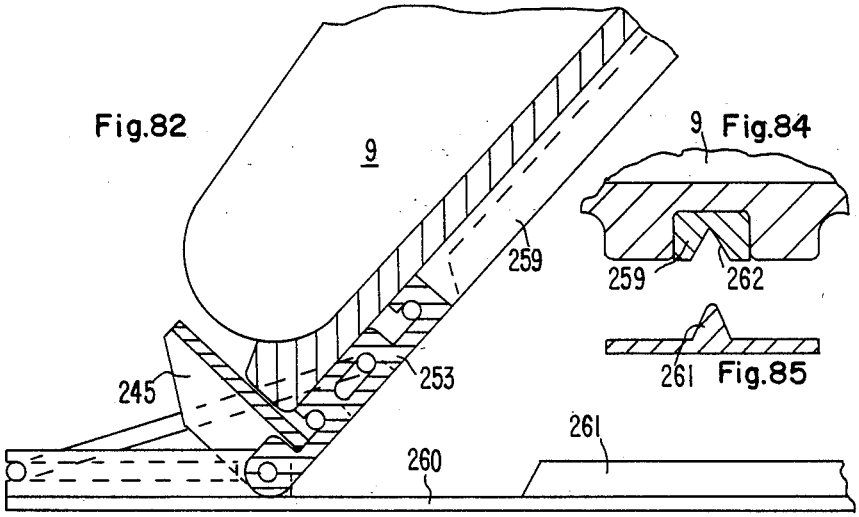
Fig.84
Fig.85

Fig. 90
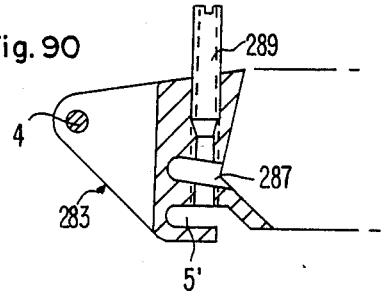
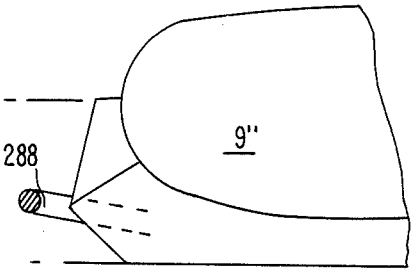
Fig.92
Fig.91
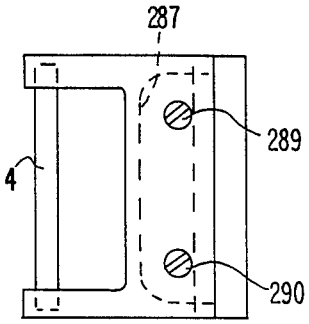
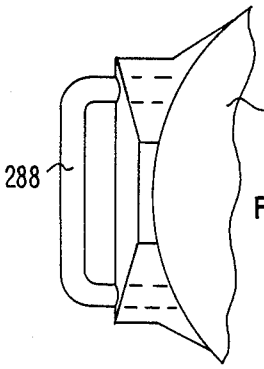
Fig. 93
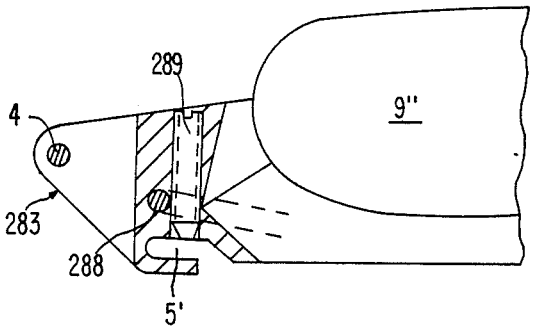
Fig.94
Fig.95
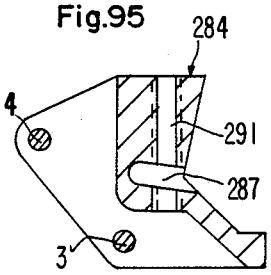
Fig.96
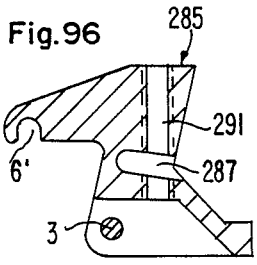
Fig.97
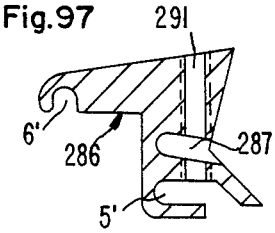

BINDING FOR CROSS-COUNTRY SKI

The present invention relates to a binding for cross-country skis, this consisting of one binding unit that is permanently attached to the ski and a second binding unit that forms a part of the ski shoe, said binding incorporating two parallel shafts of which one is held in a rigid shaft receiver in a direction perpendicular to the ski and one is spring-loaded by at least one spring element, so that the ski shoe is clamped down to the ski so as to be sprung.

A ski binding of this type is known from DE-C-29 54 446 and from numerous other examples that operate on the same principle and which are available to the trade. Common to these is the fact that a shaft is moulded into the toe of the ski shoe is inserted so as to be releasable in a shaft receiver that is part of the other binding unit, so that because of the motion required for cross-country travel the ski shoe pivots about this shaft and is simultaneously spring-loaded. The desired spring-back of the ski shoe onto the ski is achieved with this ski binding in that the force of a spring element is applied above this shaft and shaft receiver on the forward part, which is to say the tip, of the ski shoe. The shape of the toe or tip portion of the ski shoe is appropriately configured so as to accommodate the pressure of the spring. In order to avoid any direct effect of the spring element or of a body that transmits the force of the spring onto the ski shoe or onto the extension of its sole that tapers in an upwards direction, according to DE-C-29 54 446, cited above, the shaft of the ski shoe is provided with an upwardly oriented angle piece so that there are two shafts that are slightly separated and extend parallel to each other, transversely offset along parallel geometrical axes. Correspondingly, the spring element or the spring-loaded transmission body presses on the uppermost of these two shaft sections. Since both shaft sections are held in a horizontal direction only by the force of the spring element, they can twist transversely, so that the ski shoe has very little lateral stability with reference to the ski. In addition, it is only possible to open and close this ski binding manually, by operating the locking lever. Furthermore, the known spring elements of ski bindings that consist, for example, of a rubber block or a wire bale are restricted with regard to the travel of the spring and possess unfavourable spring characteristics.

It is the task of the present invention to find an improved ski binding, said binding providing good lateral stability of the ski shoe within the ski binding and which makes it easy to step into and out of the binding. The solution of this and other tasks is made on the basis of the characteristic features of patent claim 1. Numerous advantageous embodiments that are based on these features are the subject of the subsequent patent claims.

Figure 6:
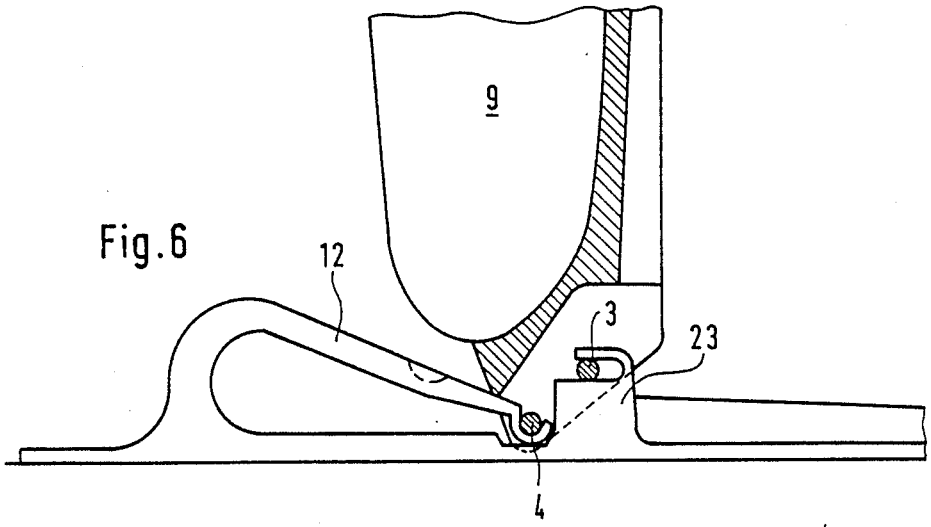
Figure 7:
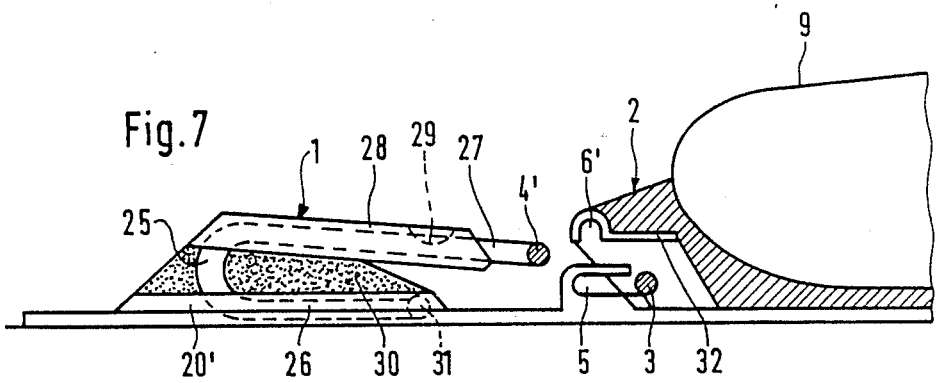
Figure 8:
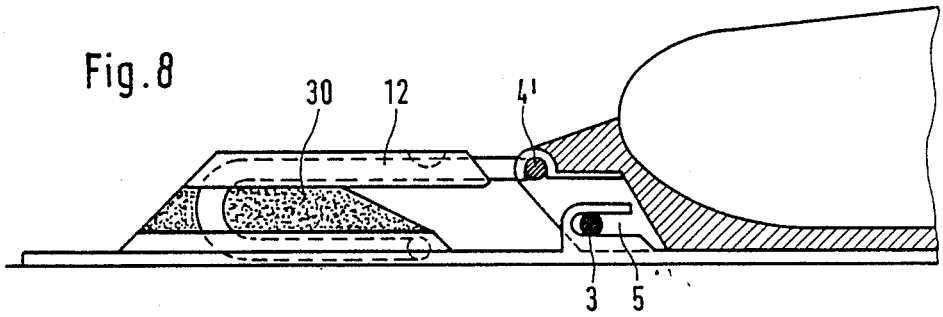
Figure 9:
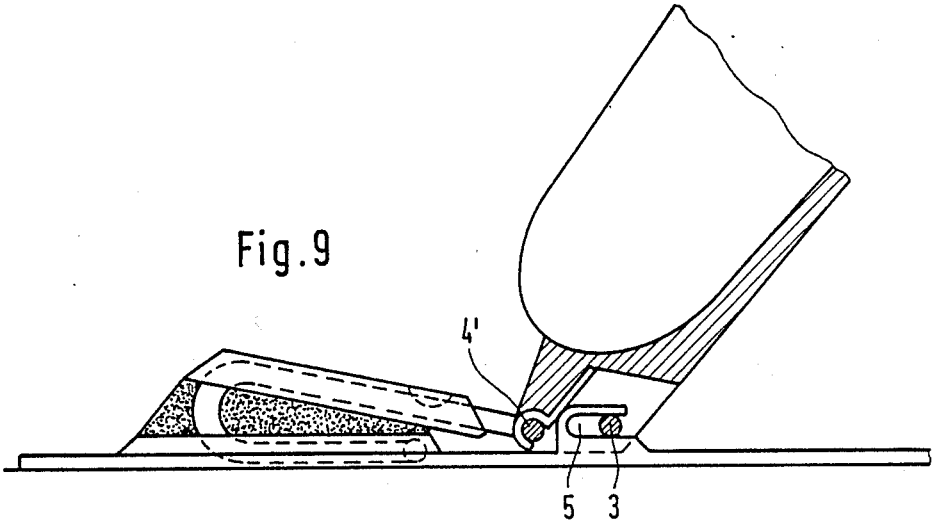
Figure 10:
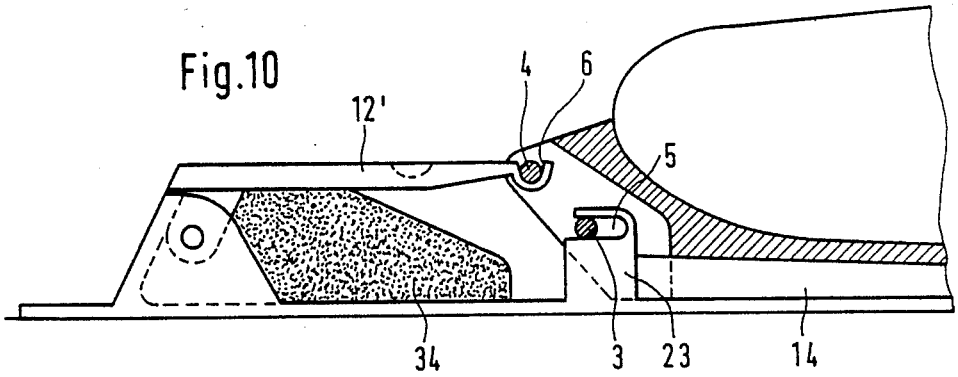
Figure 11:
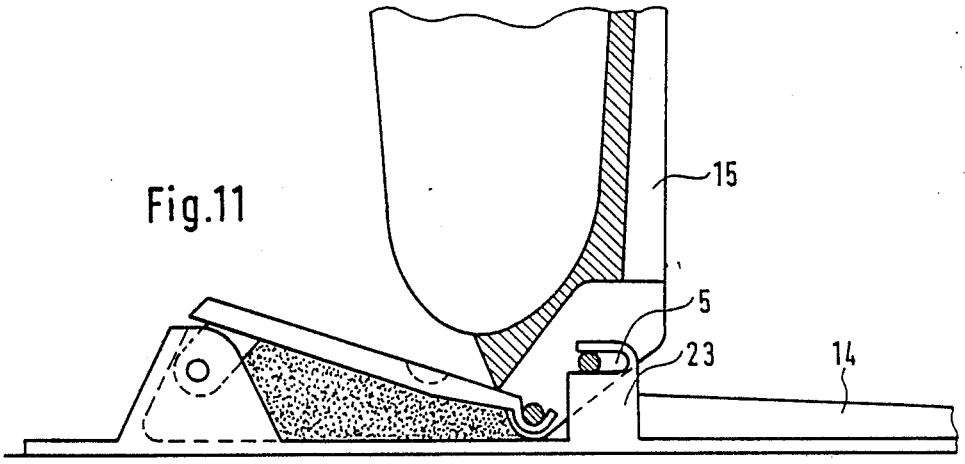
Figure 12:
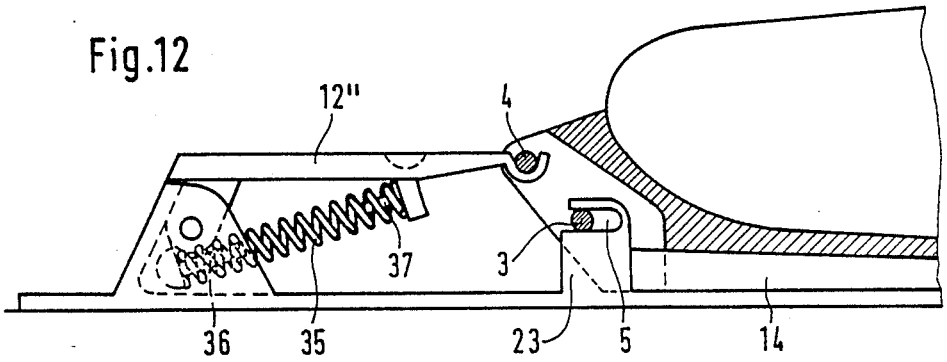
Figure 13:
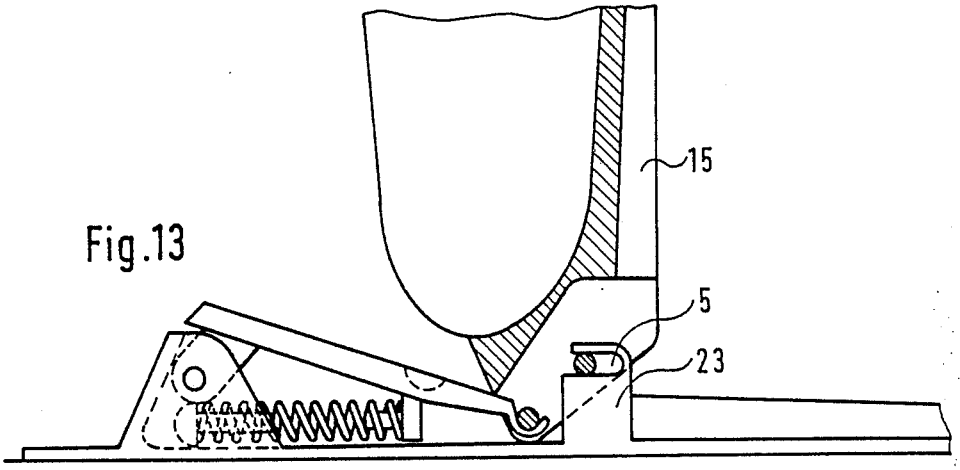
Figure 14:
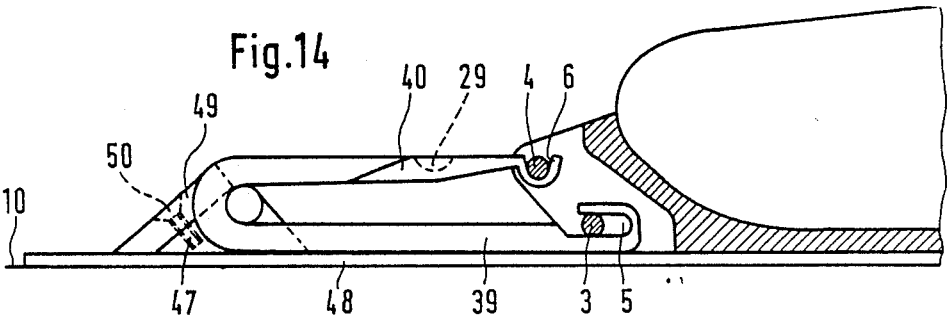
Figure 15:
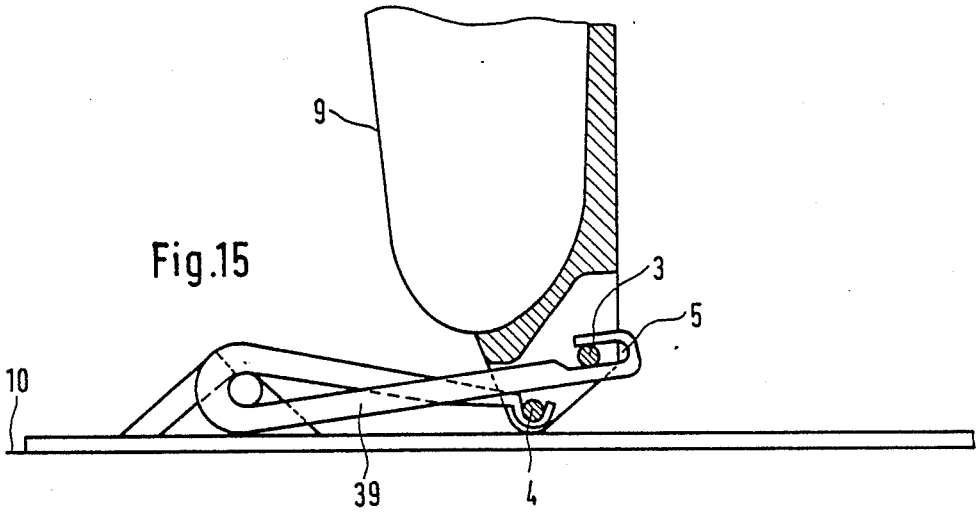
Figure 16:
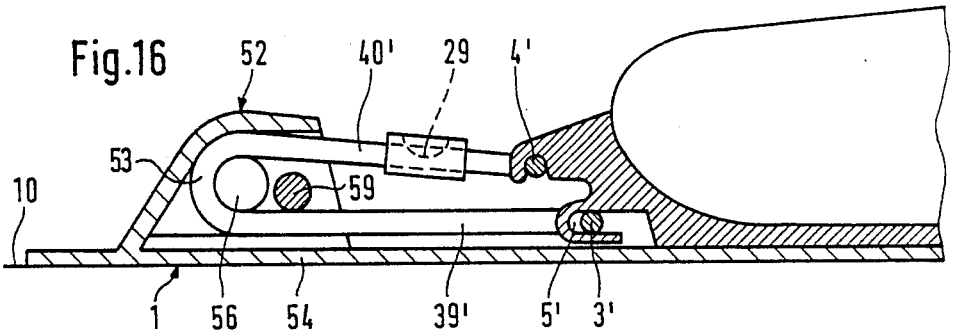
Figure 17:
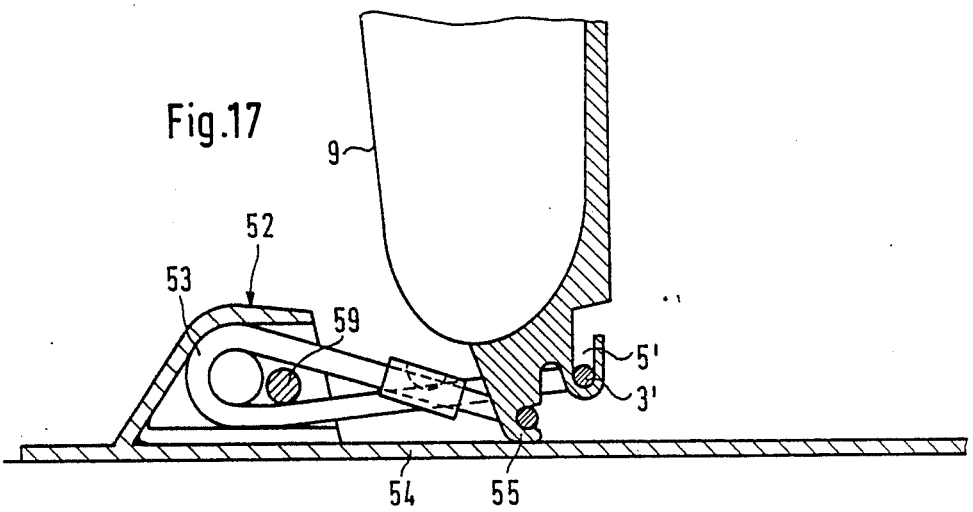
Figure 18:
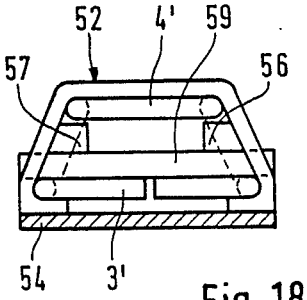
Figure 19:
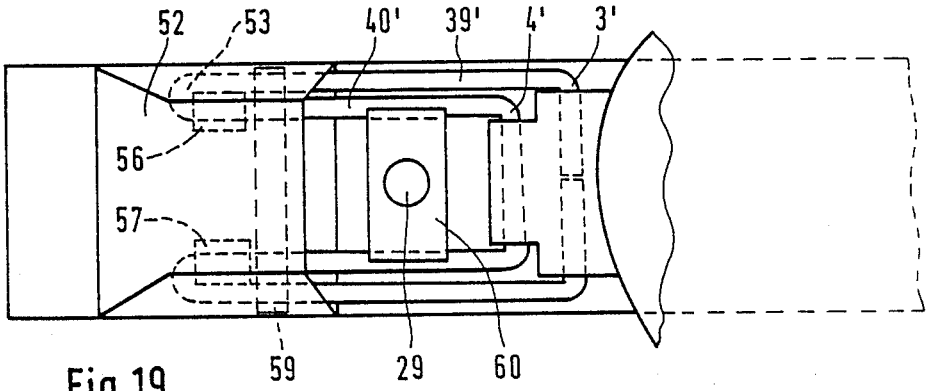
Figure 20:
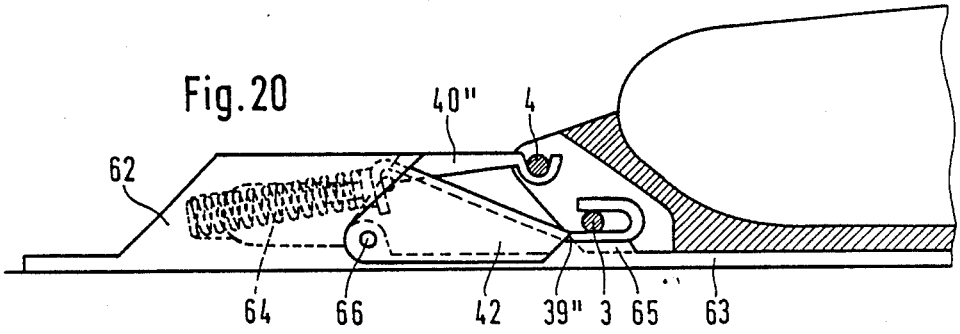
Figure 21:
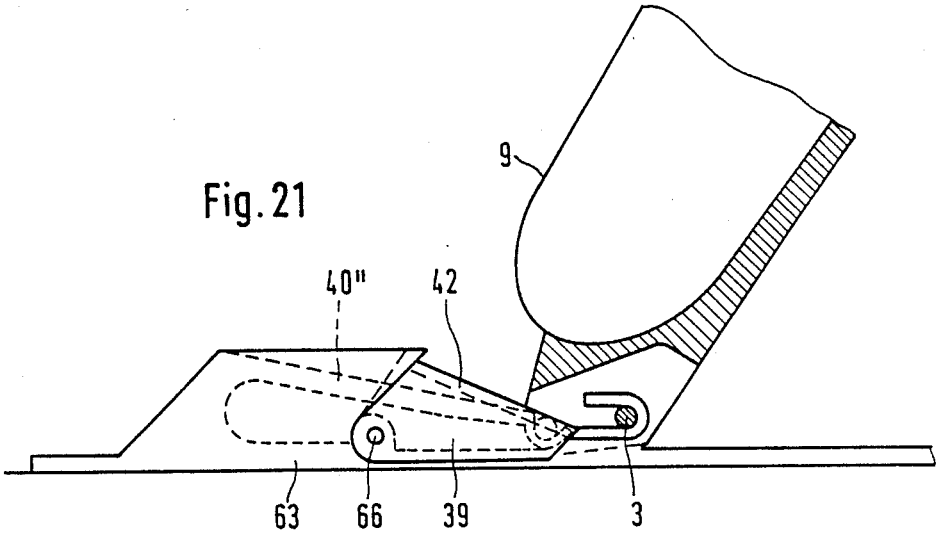
Figure 22:
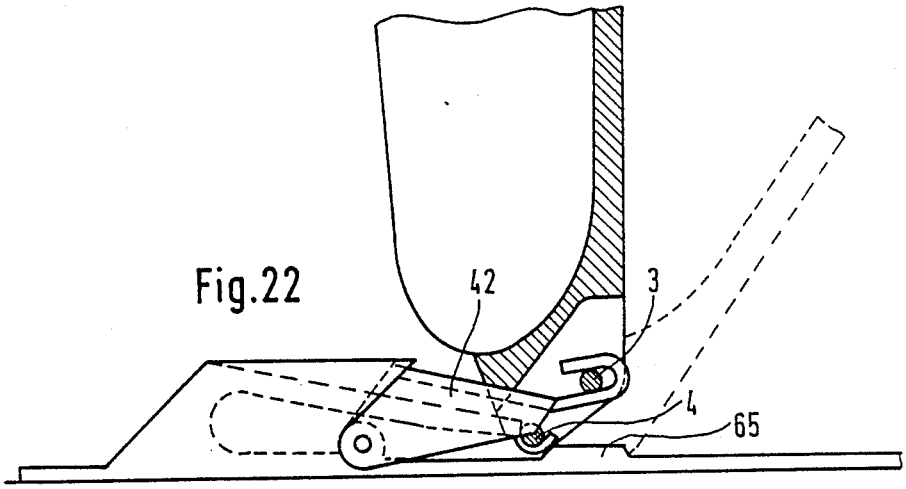
Figure 23:
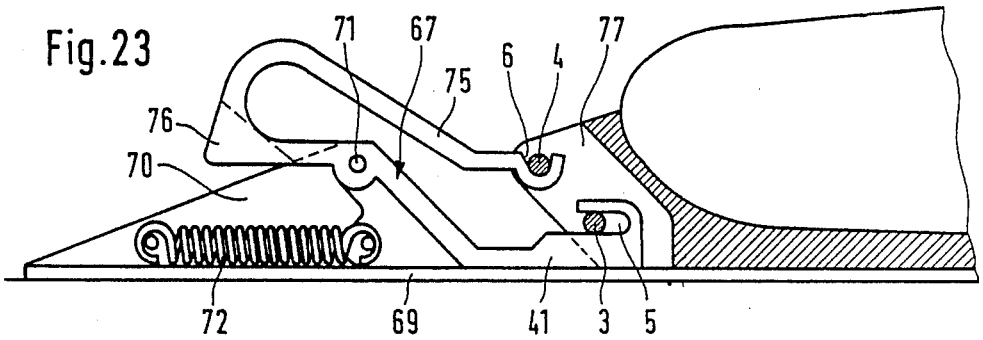
Figure 24:
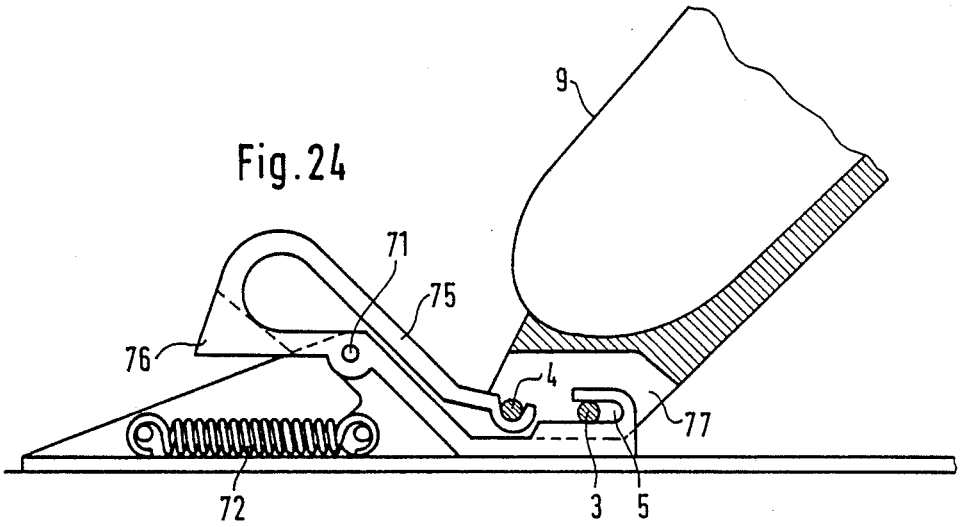
Figure 25:
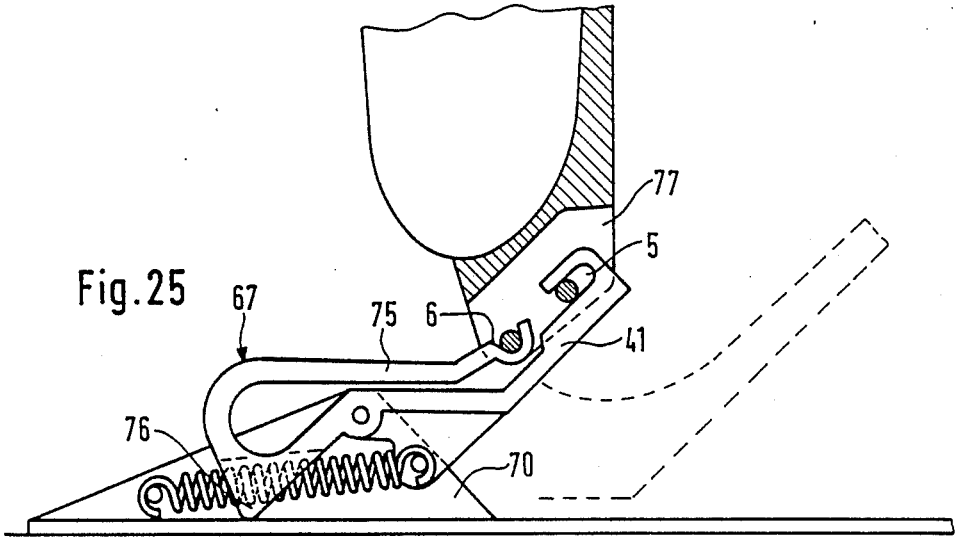
Figure 26:
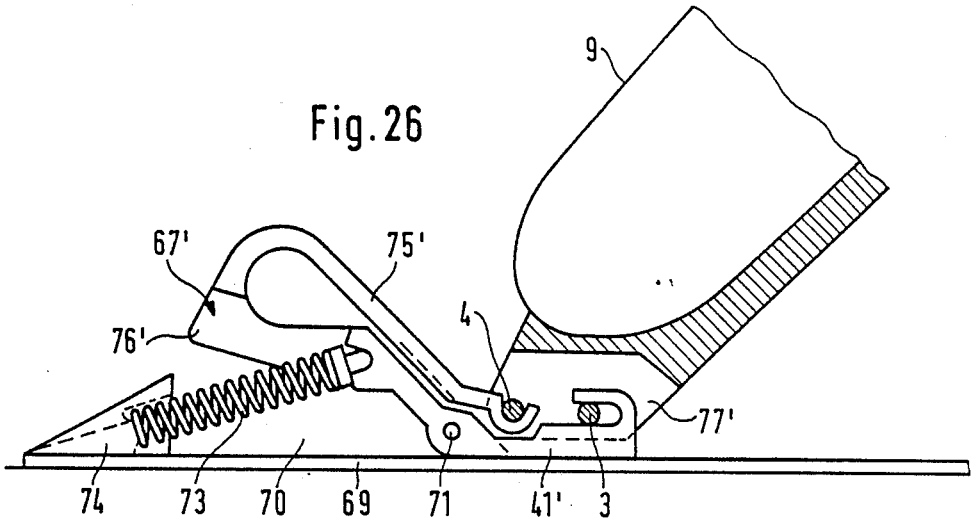
Figure 27:
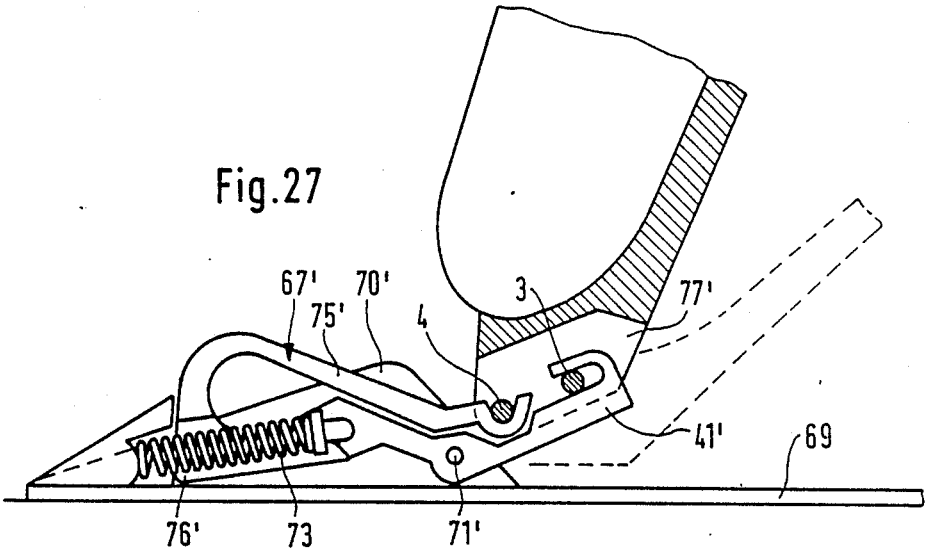
Figure 30:
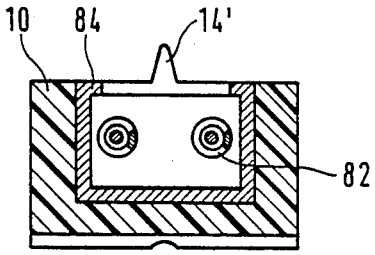
Figure 32:
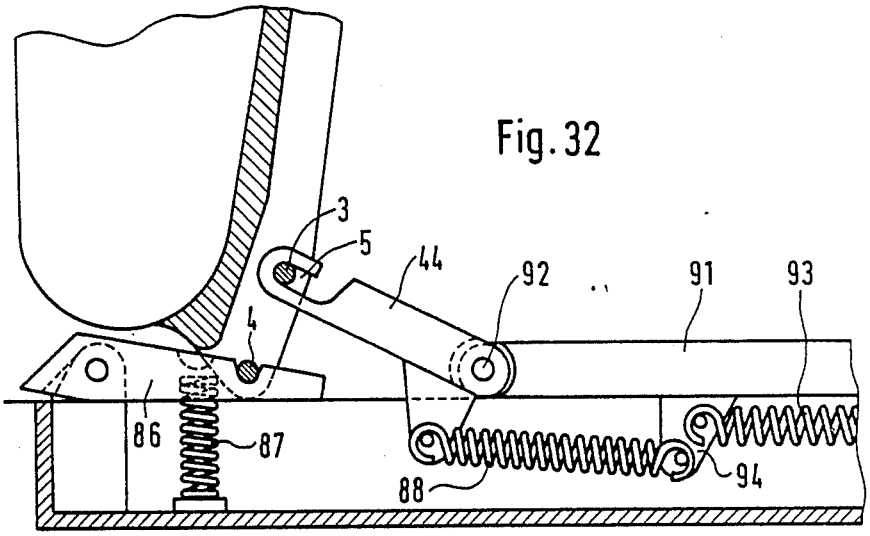
Figure 33:
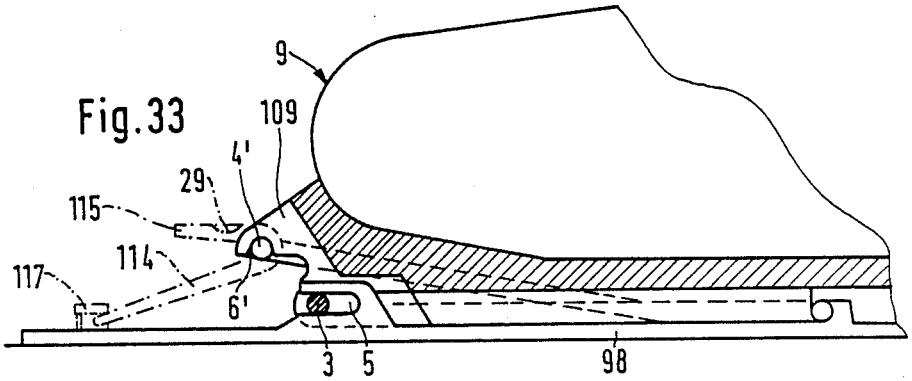
Figure 34:
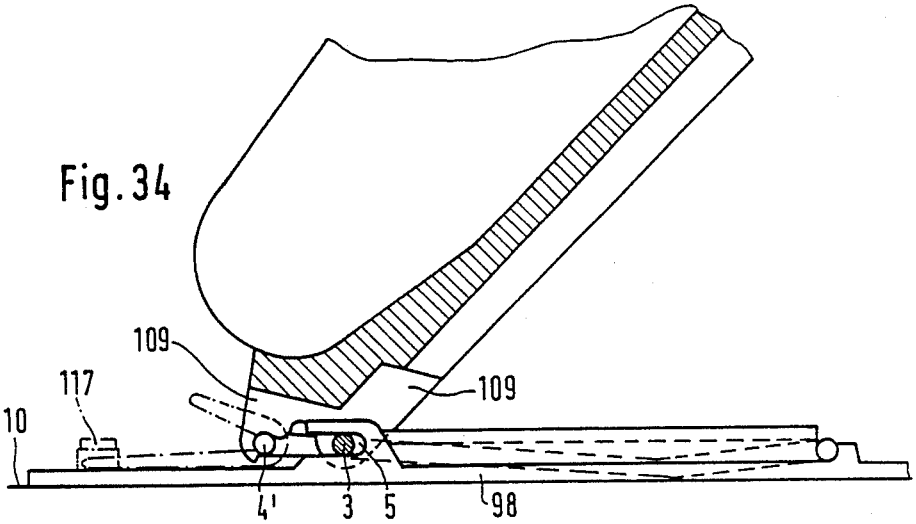
Figure 38:
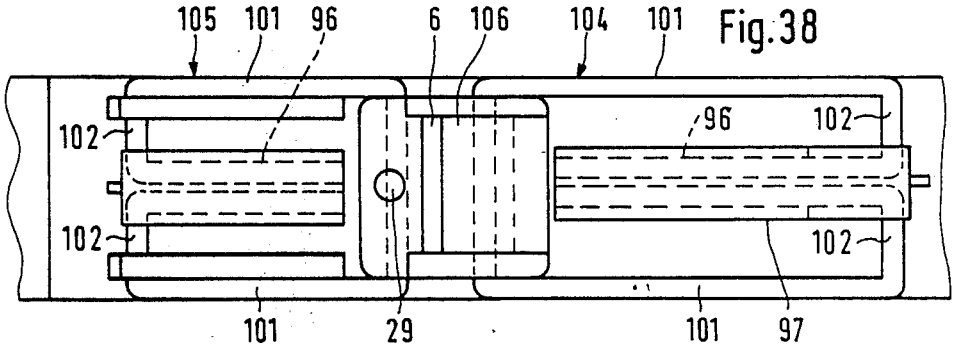
Figure 39:
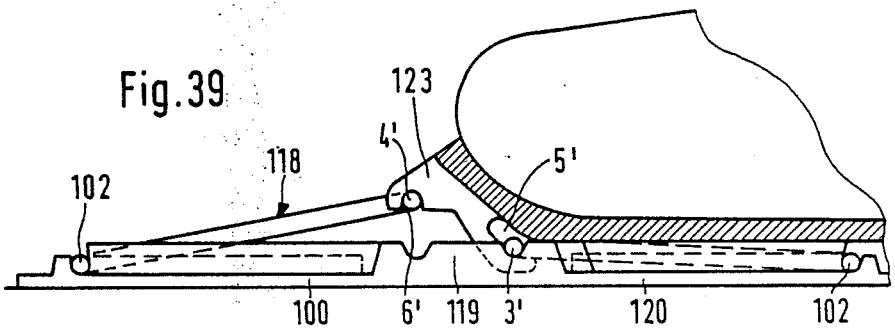
Figure 40:
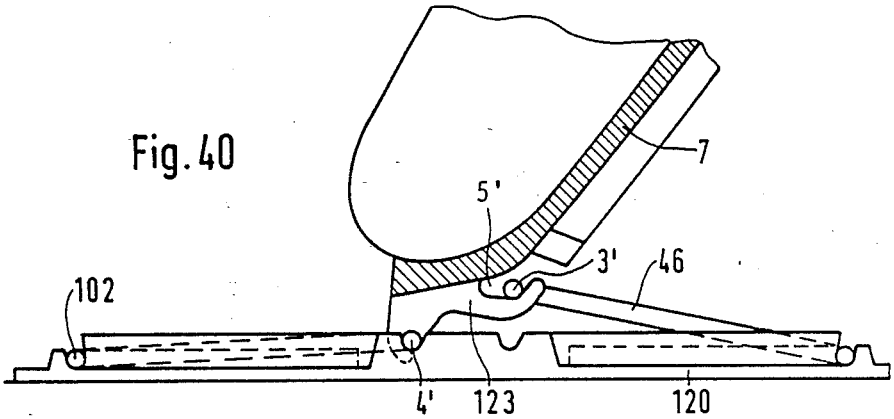
Figure 41:
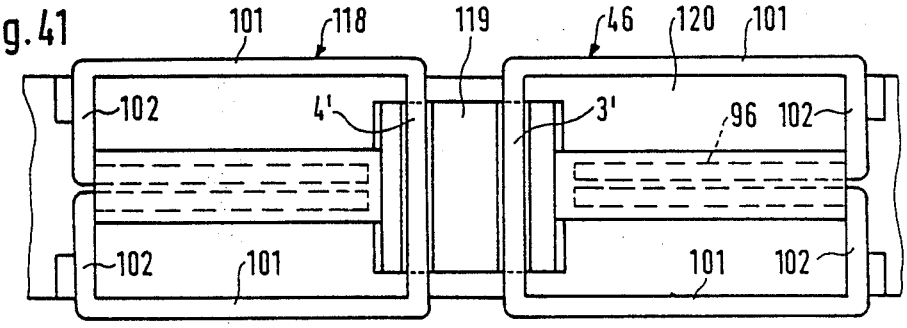
Figure 51:
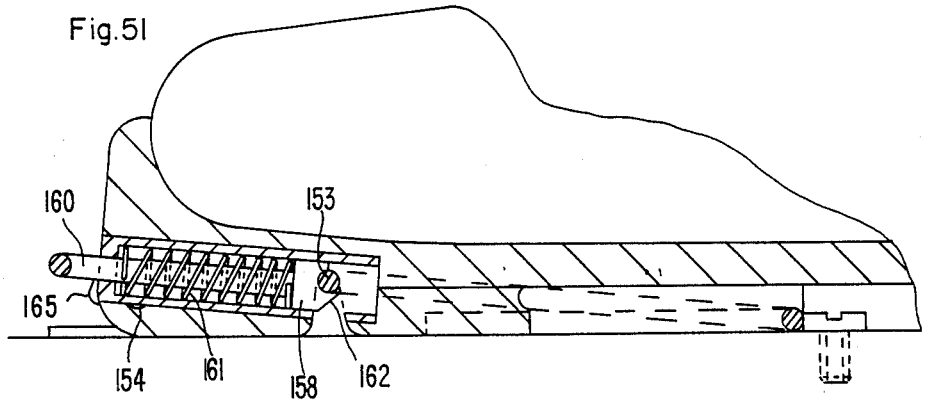
Figure 52:
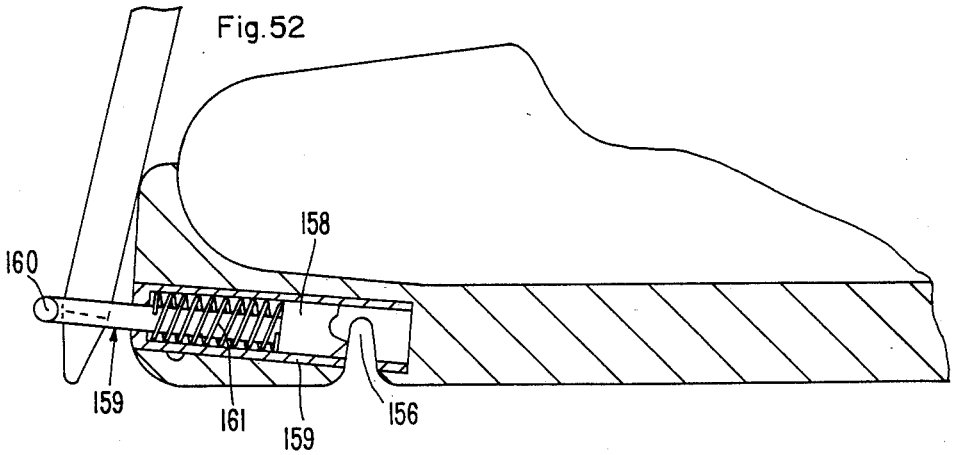
Figure 53:
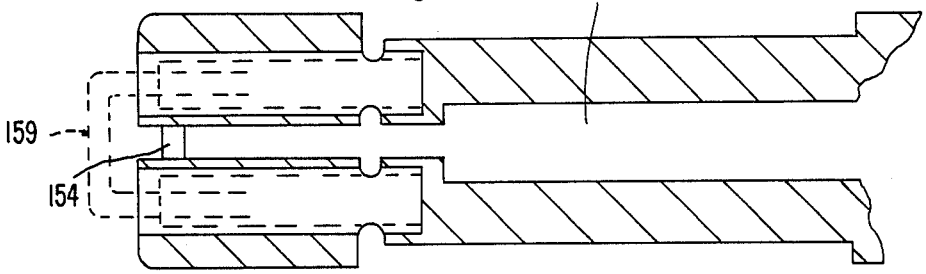
Figure 54:
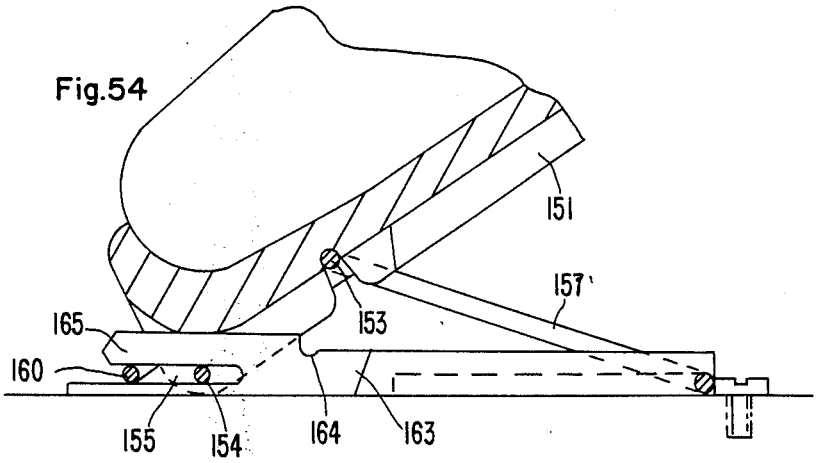
Figure 55:
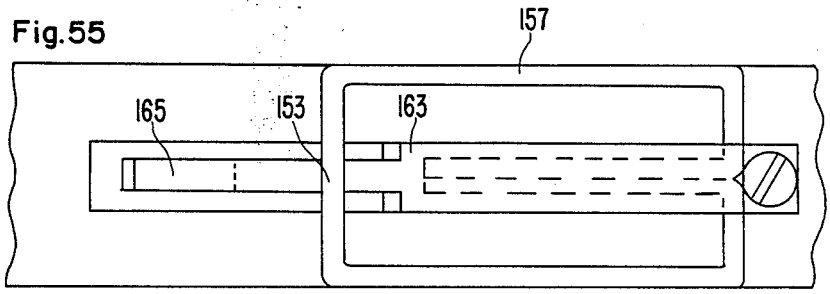
Figure 56:
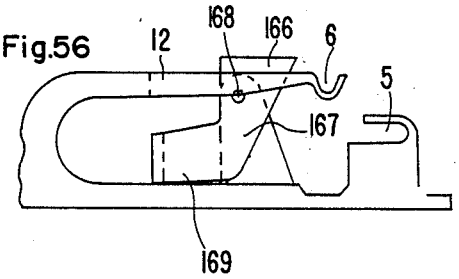
Figure 57:
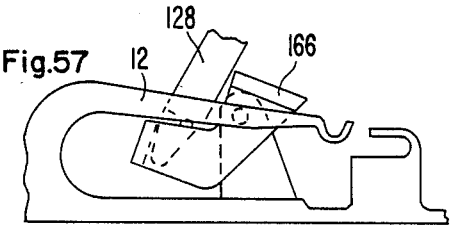
Figure 58:
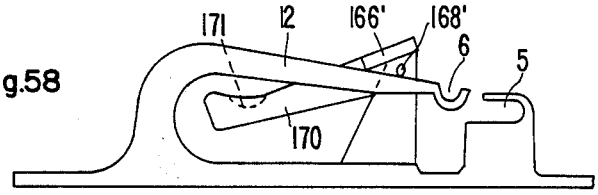
Figure 62:
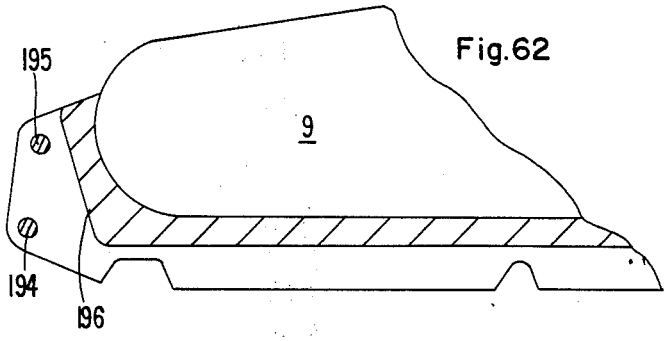
Figure 63:
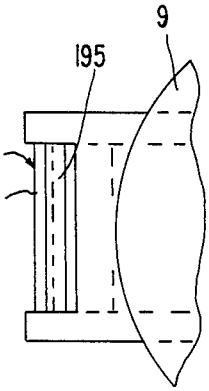
Figure 64:
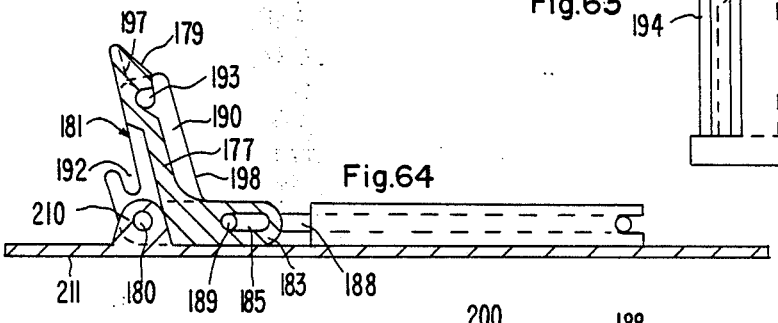
Figure 65:
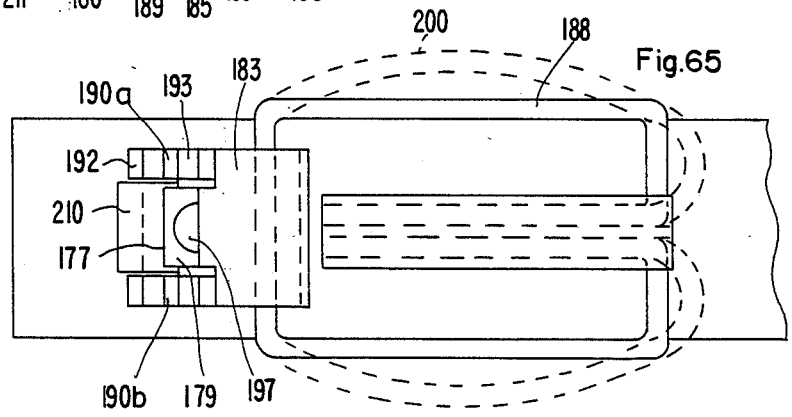
Figure 77:
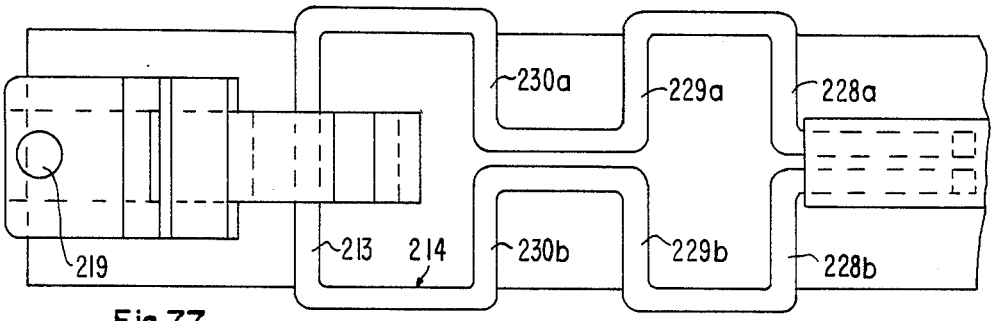
Figure 78:
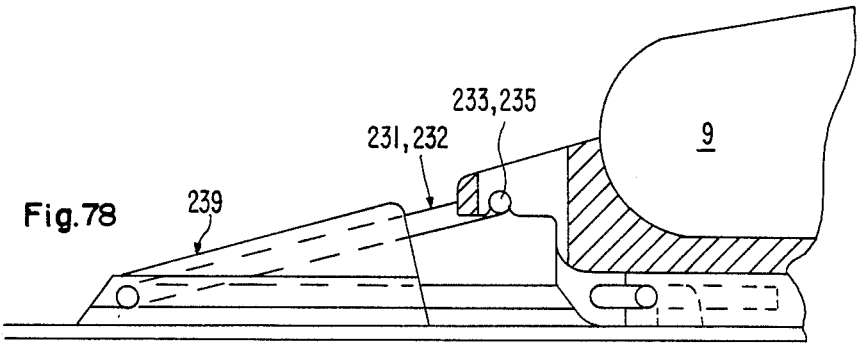
Figure 79:
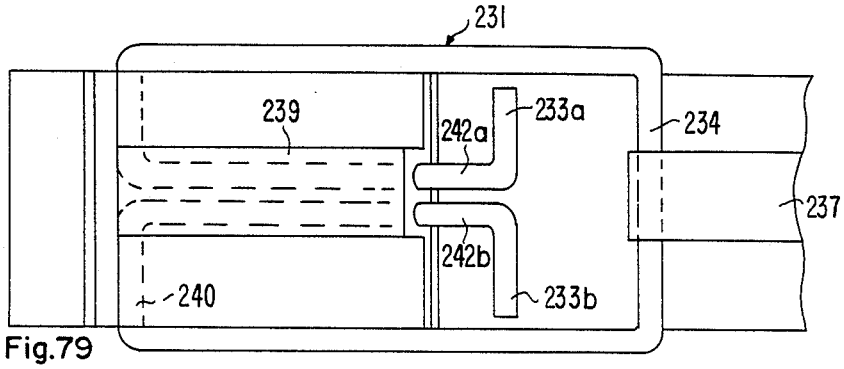
Figure 80:
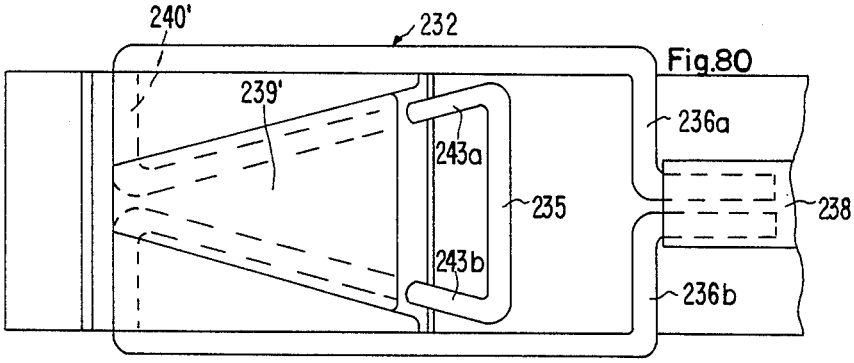
Figure 86:
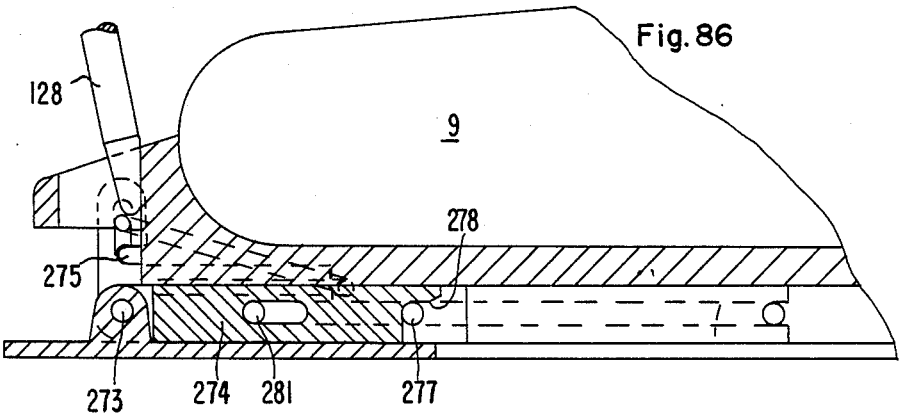
Figure 87:
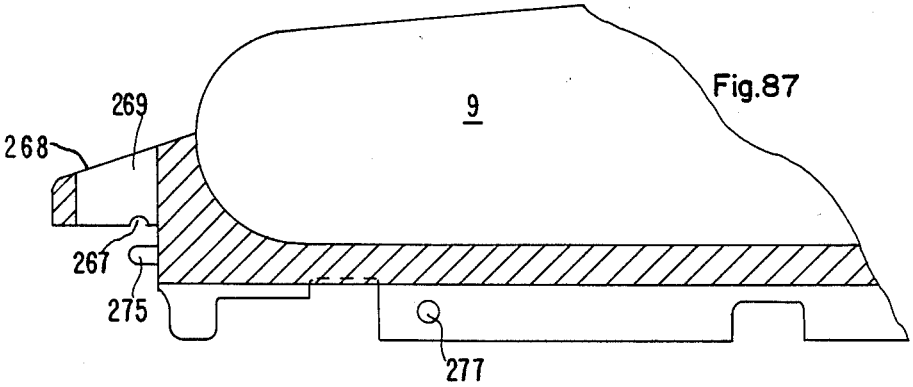
Figure 88:
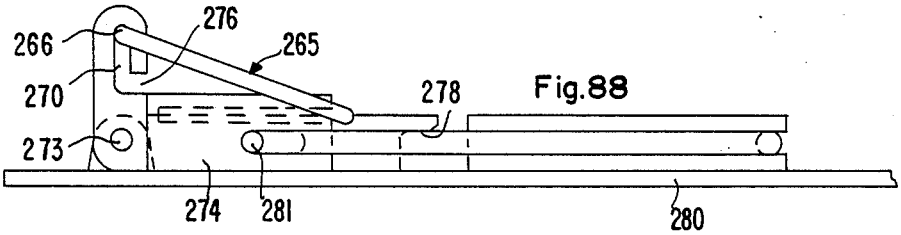
Figure 89:
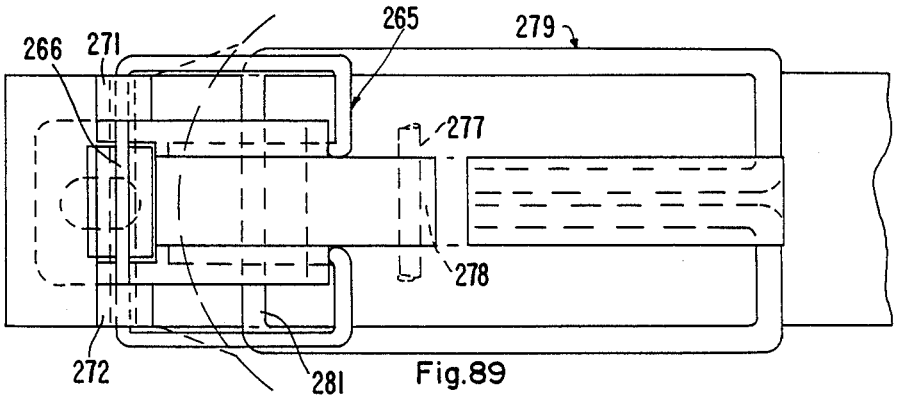

The present invention will be described in greater detail below on the basis of the embodiments shown in the drawings appended hereto. These drawings are as follows:

FIGS. 1 to 3: a longitudinal section through a cross-country ski binding with a portion of the ski shoe, in various positions;

FIG. 4: a first variation of the embodiment as shown in FIGS. 1 to 3;

FIGS. 5 and 6: a second variation of the embodiment shown in FIGS. 1 to 3;

FIGS. 7 to 9: a longitudinal section through a further embodiment of a ski binding in three positions;

FIGS. 10 and 11: a longitudinal section through a further embodiment of the ski binding, in two positions;

FIGS. 12 and 13: a variation of the embodiment shown in FIGS. 10 and 11, in two positions;

FIGS. 14 and 15: a longitudinal section through a further embodiment with ski binding in two positions;

FIGS. 16 and 17: a variation of the embodiment shown in FIGS. 14 and 15;

FIG. 18: a front view of the part of the ski binding as in FIGS. 16 and 17, attached to the ski;

FIG. 19: a plan view of the ski binding as in FIG. 16;

FIGS. 20 to 22: a further variation of the embodiment shown in FIGS. 14 and 15 in three positions;

FIGS. 23 to 25: a side view of an embodiment of the ski binding with spring elements that act one behind the other, in three positions;

FIGS. 26, 27: a variation of the embodiment shown in FIGS. 23 to 25;

FIGS. 28 to 30: a longitudinal section through a further embodiment of a ski binding in two positions, this having spring elements arranged so as to be incorporated within the ski;

FIG. 30: a cross section through the ski with the binding as in FIGS. 28 and 29;

FIGS. 31 and 32: a longitudinal section of a further embodiment of a ski binding in two positions;

FIGS. 33 and 34: a longitudinal section of a further embodiment in two positions;

FIG. 35: a plan view of the embodiment as in FIGS. 33 and 34;

FIGS. 36 and 37: a longitudinal section of a further embodiment in two positions;

FIG. 38: a plan view of the embodiment as in FIGS. 36 and 37;

FIGS. 39 and 40: a longitudinal section of a further embodiment in two positions;

FIG. 41: a plan view of the embodiment as in FIGS. 39 and 40;

FIGS. 42 and 43: in longitudinal section, two positions of a further embodiment, prior to and after engagement in the binding;

FIG. 44: a plan view of the binding unit as in the embodiment shown in FIGS. 42 and 43, this being attached to the ski;

FIGS. 45 to 47: longitudinal sections of a further embodiment, with two positions of engagement in the binding and a movement position of the first type of engagement;

FIG. 48: a plan view of the front portion of the binding unit as in FIGS. 45 to 47 that is provided on the shoe;

FIGS. 49 and 50: two embodiments of arrangements for the attachment of a binding unit to the ski;

FIG. 51: a further embodiment in longitudinal section;

FIG. 52 a longitudinal section through a portion of the ski shoe with a binding unit of the binding as in FIG. 51;

FIG. 53: in partial section, parallel to the plane of the sole, through the binding unit of the binding as in FIGS. 51 to 55 provided on the shoe;

FIG. 54: a longitudinal section through the binding as in FIG. 51, corresponding to a running position;

FIG. 55: a plan view of the binding unit of the binding as in FIGS. 51 to 54 attached to the ski;

FIGS. 56 and 57: a side view of the binding as in FIGS. 5 and 6, in two flexed positions of the spring arm, with an additional entrance aid to depress the spring arm;

FIG. 58: a side view of the binding as in FIGS. 5 and 6 with an additional embodiment of an entrance and exit aid;

FIGS. 59 and 60: a variation of the embodiment as in FIG. 5 in longitudinal section, with a latch tongue;

FIG. 61: a plan view of the first binding unit of the ski binding as in FIGS. 59, 60;

FIGS. 62 and 63: a partial view of a ski shoe in longitudinal section and in plan view;

FIG. 64: a longitudinal section through the first binding unit that matches the ski shoe as in FIGS. 62, 63;

FIG. 65: a plan view of the binding unit as in FIG. 64, shown in the direction indicated by the arrow A65;

FIG. 66: a phase of the entry movement of a ski binding corresponding to FIGS. 62 to 65 with the latch tongue depressed into the release position, with a slightly modified holder for the spring clip;

FIG. 67: a movement position of the ski binding according to FIG. 66;

FIG. 68: a longitudinal section through the front portion of the ski shoe with a second binding unit of a further embodiment of a ski binding;

FIG. 69: a front view of the ski shoe as in FIG. 68;

FIG. 70: a longitudinal section through the first binding unit for the ski shoe as in FIGS. 68, 69:

FIG. 71: a front view of the binding unit as in FIG. 69;

FIGS. 72 and 73: longitudinal sections through the ski binding with the ski shoe and the binding unit as in FIGS. 68 to 71, during entry into the ski binding and in the locked position;

FIGS. 74 to 76: longitudinal sections through a further embodiment of the ski binding in the locked position, during entry and in a movement position;

FIG. 77: a plan view of the first binding unit of the ski binding as in FIGS. 74 to 76;

FIG. 78: a longitudinal section through a variation of the embodiment as in FIGS. 42 to 44;

FIGS. 79 and 80: two embodiments of the first binding unit for the version shown in FIG. 78;

FIGS. 81 and 82: longitudinal sections of a further embodiment of the ski binding in two movement positions;

FIG. 83: a plan view of the first binding unit as in FIG. 81;

FIG. 84: a partial cross section through the shoe sole with the rib of the first binding unit engaged;

FIG. 85: a cross section through the base plate of the first binding unit as in FIGS. 81 to 83;

FIG. 86: a longitudinal section through a further embodiment of the ski binding;

FIG. 87: a longitudinal section through the ski shoe of the ski binding according to FIG. 86;

FIG. 88: a side view of the first binding unit for the ski shoe as in FIG. 87;

FIG. 89: a plan view of the binding unit as in FIG. 88;

FIGS. 90 and 91: a longitudinal section and a plan view of a binding adaptor;

FIGS. 92 and 93: a longitudinal section and a plan view of the front part of the shoe for which the binding adaptor is intended;

FIG. 94: a longitudinal section of the binding adaptor when installed;

FIGS. 95 to 97: longitudinal sections of the binding adaptors for three various first binding units.

In order to simplify the drawings the binding units that are attached to the skis are mainly shown unshaded. The drawings illustrate numerous fundamental embodiments of the invention and variations thereon, e.g., according to FIGS. 1 to 13, FIGS. 14 to 22, FIGS. 23 to 27, FIGS. 28 to 38, FIGS. 31, 32 FIGS. 33 to 35, FIGS. 36 to 38, FIGS. 39 to 41, FIGS. 42 to 44, FIGS. 45 to 48, FIGS. 49, 50, FIGS. 51 to 55, FIGS. 56 to 58, FIGS. 59 to 61, FIGS. 62 to 67, FIGS. 68 to 73, FIGS. 74 to 77, FIGS. 78 to 80, FIGS. 81 to 85, and FIGS. 86 to 89.

Common to many embodiments of the present invention is the connection between both binding units 1, 2 by way of two shafts 3, 4, which are objects of the present invention, each of these being so enclosed by a shaft receiver 5, 6 of the other binding unit such that the shaft 3 and 4 can be releasably installed in a direction transverse to the shaft within the shaft receiver 5, 6. In the embodiments that are shown, a shaft 3 that is arranged closer to the sole 7 of the shoe ensures vertical fastening of the front area 8 of the ski shoe 9, and an associated shaft receiver 5 is in the form of a slot which, at least when the ski position is in the initial position or when the shoe 9 is resting on the ski, runs parallel to the ski or to its running surface. Both of the shaft receivers 5, 6, are of U-shaped cross section and hence for the shaft receiver 5 of the shaft 3 is oriented parallel to the ski. In contrast to this, the U-shaped cross section of the other shaft receiver 6 is oriented so as to be perpendicular to the ski, so as to fix both binding units 1, 2 in the longitudinal direction of the ski as well as for lateral guidance; only the upper surface 10 of the ski is shown in the drawings. Both the shafts 3, 4 are of circular cross section so that they can rotate within their associated shaft receivers in the same way as in bearing shells. The slot shape of the shaft receiver 5 permits a longitudinal displacement of the shaft 3, which, when the other shaft 4 moves on a circular path, ensures the necessary equalization of the distance between the shaft receivers 5, 6.

In the first basic embodiment as shown in FIGS. 1 to 13, one of the shaft receivers, i.e., the shaft receiver 5 for a shaft 3 which is secured to the binding unit 2 of the ski shoe 9, which closer to the sole 7 of the shoe, is formed rigidly as part of the binding unit 1 that is secured permanently to the ski, and the second shaft receiver 6 is located either at the outer end of a spring arm 12, i.e., if the second shaft 4 is also secured to the binding unit 2 of the ski shoe 9, or at a suitable place on this binding unit 2, as is shown in the examples illustrated in FIGS. 7 to 9. In the latter case, there is a shaft 4' provided on the spring arm 12 in place of a shaft receiver 6.

In all of the embodiments of the invention, both the spring arm or a corresponding spring element, as well as the shaft 3, 4, 4' can consist of a plurality of parts arranged adjacent to each other in the transverse direction of the ski. For example, in place of an arm 12 in the form of a plate or a spring tongue, a plurality of arm sections that are spaced apart and parallel to each other can extend in the longitudinal direction of the ski. In place of a continuous shaft that is secured only at its two ends there can be a plurality of shaft sections that extend transversely to the ski on the same geometric axis; these can also be formed from one piece; and only enclosed, by sections, by means of shaft-retaining elements. In such an embodiment there is a hinge-like meshing between the sections of the shaft and the associated elements of a shaft receiver 5,6.

A comparison between the four variations of the first basic embodiment with regard to the spring system, i.e., corresponding to FIGS. 1 to 6; 7 to 9; 10 and 11, and 12 and 13 shows that the spring arm 12 can be sprung in various ways, so that its free end, which bears the shaft receiver 6 or the shaft 4' attempts to move the counterpart of this shaft connection 4, 6, 4', 6', i.e., the shaft 4 on the ski shoe or the binding unit 2 or the shaft receiver 6' on the ski shoe along a circular path about the other shaft 3. As a consequence, the force of the spring action on the arm 12 forces the ski shoe 9 about the shaft 3 downwards on the ski 10, so that the ski shoe 9 rapidly finds its optimal lateral guidance on the ski and on the lateral guide means attached to this, i.e., on a side groove rib 14, by means of a suitably formed groove 15 and, in addition, in each position in which the ski shoe 9 is pivoted relative to the ski 10 there is a prestressed, reliable connection with no free play between the two binding units 1 and 2.

The variation that is shown in FIGS. 1 to 6 has a binding unit 1 that is produced in one piece of very tough elastic plastic that becomes a foot plate 16 that incorporates a side guide rib 14 and is cemented to the upper surface 10 of the ski. Modern adhesive technology makes it possible to achieve a cemented joint of sufficient strength, and thus makes it possible to dispense with additional screws. In addition, the binding unit 1 is provided with a plate-like extension 18 on its side that is remote from the ski shoe so that a relatively large adhesion surface is available. The leaf-spring-like connector arm 12 is formed through a pedestal-like thickened section 19 on the continuous binding or adhesion plate 20, respectively, and extends in the longitudinal direction of the ski, so that there is a fork-shaped longitudinal cross section between the binding plate 20 and the binding arm 12. The width of the opening of this cross section fork permits a relatively large tilting movement of the ski shoe 9, insofar as the upper shaft 4 of the binding element 2 that is formed on the ski shoe 9 can pivot downwards about the lower shaft 3 sufficiently and in a suitable manner. This tilting movement can be increased by means of a depression 22 provided at a suitable location in the binding plate 20, as is seen in FIG. 3. The variations shown in FIGS. 5 and 6, 10 and 11, and in 12 and 13 show how the degree of mobility of the ski shoe 9 can be increased by the elevated arrangement of the pedestal-like section 23. FIG. 6 illustrates the resulting larger spring flexion of the spring connector arm 12.

For adjusting the spring force of the spring elements of the binding or of the spring arms, special adjusting means may be provided, eg. the resilient support body 11 of FIG. 2, the position of which between the resilient arm 12 and the binding plate 20 may be adjusted for changing the position of support.

In the variations shown in FIGS. 7 to 9, there is a spring clip 25 incorporated in the binding unit 1 that is permanently attached to the ski, and one arm 26 of this is inserted so as to be shape-locking within the binding plate 20 or else is cast in place, whereas the other spring arm 27 which extends in the manner of a fork bears a housing plate 28 on which there is a depression 29 to accommodate the tip of a ski pole that can be used to depress the shaft 4 of the spring clip 25 in order to release the ski binding. The present invention provides for corresponding depressions 29 in the other embodiments of the ski binding according to the present invention. The space between the binding plate 20' and the housing plate 28 can be filled, for example, with a rubber-like filler material 30. The spring clip 25 consists, for example, of a closed extended rectangular clip, the long arm of which is bent in the form of a hair grip as shown in the drawing and a cross shaft 31 are connected by the shaft 4' for the binding engagement. The latter serves to anchor the spring clip 25 into the binding plate 20'. According to this embodiment, the shaft receiver 6' that is provided in the binding unit 2, i.e., on the ski shoe 9, is formed in a suitably bent sheet metal part 32 that is attached rigidly to the ski shoe by adhesion, vulcanizing, or by some other means.

The embodiment illustrated in FIGS. 10 and 11 shows that in a ski binding according to the present invention the spring force can also be generated by means of a rubber-elastic body 34 in that this acts on the arm 12', at the free end of which the shaft receiver 6 is located.

The embodiment shown in FIGS. 12 and 13 differs to that shown in FIGS. 10 and 11 in the use of a compression spring 35 that acts on an arm 12" the ends of which are secured by the pins 36, 37 that extend into said spring.

The embodiments that are described below differ, with the exception of those as shown in FIGS. 33 to 35, from the embodiments described above in that a part 3, 5 or 3', 5', respectively, of the shaft connection that is rearmost when viewed in the longitudinal direction of the ski, is provided on a binding element 39, 39', 41, 41', 42, 43, 44, 45, 46 so as to permit a greater possible pivotal range of the ski shoe 9, for example, up to 90° relative to the top surface of the ski 10, and this part can be moved upwards and away from the ski against the spring force.

In the embodiments shown in FIGS. 14, 15 and in FIGS. 16 to 19, there is a shaft receiver 5 (FIGS. 14, 15) or a shaft 3, respectively at the unattached end of a spring arm 39 or 39', respectively, that is attached by its other end to the mounting pedestal 47 of the binding plate 48 such that is cannot pivot. According to FIGS. 14 and 15 the spring arm that is configured as a narrow plate extends between two outer and upper spring arms 40 that have the shaft receiver 6 at the free end, such that it is bent upwards between these when the ski shoe 9 pivots upwards when moving, as is shown in FIG. 15. Both the spring arms 39, 40 are formed from one piece of elastic plastic material on which there is a plate-like extension 49, through which the spring arms 39, 40 are secured to the pedestal 47 by means of screws 50. As can be seen in FIGS. 16 to 19, the spring arms 39', 40', are configured in one piece, from spring wire, in the form of a clip, so that the two cross pieces of the clip form the shafts 3', 4' of the binding unit 1. A mounting pedestal 52 which encloses the area 53 of the binding situated between the spring arms 39', 40', in the manner of a housing, secures this to the ski such that it cannot pivot, and so that the spring arm 39' remain parallel to the top surface 10 of the ski until the ski shoe 9 pivots upwards on its tip 55 that rests on the binding plate 54. The arc-shaped areas 53 of the binding enclose on both sides internal pegs 56, 57 that are moulded into the mounting pedestal, the areas 53 being installed on the pegs 56, 57 after they have been pressed towards each other transversely to the ski. The mounting of the area 53 of the binding which is secured so as to be unable to rotate is achieved, for example, by a pin 59 that passes transversely through the housing-like pedestal 52, including its side walls, thereby holding the lower spring arms 39′ down. The two upper parallel spring arms 40′ are connected to each other by means of a short plastic plate 60 that incorporates a depression 29 to accommodate the tip of a ski pole.

There is also an upper and a lower spring arm 40″, 42 in the embodiment shown in FIGS. 20 to 22. The upper spring arm 40″ is formed in one piece with the part 62 of a pedestal on the binding plate 63 and is in the form of a plate, so that it flexes in the manner of a leaf spring. FIG. 21 indicates this by dashed lines as it is when bent downwards, as in a pivoted position of the ski shoe 9, in which the lower spring arm 42 that is acted upon by the spring 64 still rests against a raised portion 65 of the binding plate 63 under the pressure of this spring 64. As an example, there are two parallel lower spring arms 42 which in the position shown in FIG. 21 enclose the upper spring arm 40″ between themselves and are each acted upon by a spring 64. Each spring 64 is supported at a distance from the shaft bearing 66 of the spring arm 42 that is triangular when viewed from the side, and on the other end on the pedestal 62.

The embodiments shown in FIGS. 23 to 27 have a spring rocker 67, 67′, that can pivot about a shaft 71, 71 that is fixed on the binding plate 69 or a part 70, 70′ of the pedestal, if the ski shoe 9 is pivoted upwards beyond the pivoted position shown in FIG. 24 or 26, respectively. In the version shown in FIGS. 23 to 25 the spring rocker 67 is retained in the position shown in FIGS. 23 and 24 by means of a spring 72 that is installed in the pedestal 70; in this position, one arm 41 of the rocker with its shaft receiver 5 is pressed down onto the binding plate 69. In the embodiment shown in FIGS. 26 and 27, in place of this there is a compression spring 73 above the shaft 71′ and this engages on the spring rocker arm 67′; at its other end this is supported by a front raised portion 74 of the binding plate 69.

The other or upper spring rocker arm 75, 75′ acts in a manner comparable to the upper spring arm 12, 12′, 12″ of the embodiments shown in FIGS. 1 to 13, and is appropriately sprung so as to be able to flex downwards towards the lower rocker arm 41, 41′, so as to be able to act against the upward pivoting motion of the ski shoe 9 between the positions shown in FIGS. 23 and 24. The pivotal range of the spring rocker arm 67, 67′ can be limited to the front by the arrangement of an extension 76, 76′ at the forward outer end of the upper arm 75, 75′ of the rocker. The spring rocker 67, 67′ with its arm 41, 75; 41′, 75′ is, for example, of flexible, elastic plastic and is the same width as the ski. The shafts 3, 4 of the ski shoe 9 are, for example, moulded in on both sides on a centre rib piece 77, 77′ that engages in a centre slot in the area of the shaft receivers 5, 6 that is perpendicular to the binding plate 69 and extends in a longitudinal direction when the binding is engaged.

In the embodiment shown in FIGS. 28 to 30 a rigid rocker 79 can pivot about a shaft 81 that is incorporated in a portion 80 of the pedestal against the force of a spring 82, the two arms 43 and 83 of which incorporate the shaft receivers 5, 6. The shaft 81 is arranged slightly above the ski and when the ski shoe is pivoted upwards the arm 83 of the rocker descends into a longitudinal binding housing 84 that is let into the ski. The pedestal 80 is secured within this housing and a spring 82 that is installed around the guide shaft 85 is accommodated within this binding housing. When arranged in front of the pedestal 80 a tension spring can be arranged and let into the ski in place of the compression spring 82. The side guide rib 14′ that is known in and of itself and is intended to engage with a groove in the sole 7 of the shoe is formed above this housing 84. FIG. 30 illustrates the arrangement of two parallel compression springs within the binding housing 84.

In the embodiment shown in FIGS. 31 and 32 the shaft receivers 5, 6 are provided on two independently supported levers 44, 86, each of which is acted upon by a spring 87, 88. The lever 86 which is at the front viewed in the direction of the ski is supported at the front end of a housing 89 that is let into the ski 10 on a shaft 90, and is acted upon in an upwards direction by a compression spring 87 so that the shaft receiver 6 attempts to thrust the front shaft 4 of the ski shoe 9 upwards and thus the sole 9 of the shoe downwards onto the guide rails 91. The pivoting movement of the ski shoe 9 that takes place when the ski is moved presses the front lever 86 downwards against the compression spring 87 and draws the rear lever 44 upwards against the force of the tension spring 88. When this happens, the rearmost lever 44 pivots about a shaft 92 at the front end of the guide rail 91 and at the same time draws the sliding guide rail 91 forward against the force of a second tension spring 93. Both of these tension springs 88, 93 are attached to the same extension piece 94 that is located on the underside of the guide rail 91. The guide rail 91 is, for example, of a T-shaped cross section to provide for its sliding mounting on the ski, the cross piece of this T being supported in a channel.

In the embodiment shown in FIGS. 33 to 41 a more or less flat clip that is of spring steel is used, this being in the form of a rectangle that extends in the direction of the ski, this having two inner arms 96 that are parallel to the longitudinal side arms of the clip and having unattached ends or having ends that are angled, as is shown in FIGS. 35, 38, and 41. The inner arms 96 are in each instance retained in a central longitudinal channel 97 in the binding plate 98, 99, 100, and are held flat on the top surface 10 of the ski, whereas the clip arms 101 form spring loaded pivoting arms. Thus the parts of the clip that extend transversely between the clip arms 101 and the inner arms 96 form torsion bars 102 and the portion of the clip that joins the clip arms 101 forms a shaft 3′, 4′ to engage in a shaft receiver 5′, 6′ of the ski shoe (FIGS. 33–35, and FIGS. 39–41) or for the support of a body 106 that joins two clips 104, 105 of this kind as shown in FIGS. 36 to 38, on which the two shaft receivers 5, 6 are located.

In the embodiment shown in FIGS. 33 to 35 there is only one rectangular clip 107, this being held beneath the ski shoe 9 by means of the binding plate 98. That portion of the clip which forms the shaft 4′ engages with the front shaft receiver 6′ of the ski shoe 9, that is in each instance formed in two parallel rib pieces 109 that are formed so as to be perpendicular to the binding plate 98; these rib pieces 109 engage between the clip arm 101 and an engagement block 110, so that the shaft receivers 6′ encircle the shaft 4′ at the points 111. The rear shaft receiver 5 that is fixed vertically to the ski is configured as a slot that is parallel to the top surface of the ski, so that the rear shaft 5 that extends between the two cross pieces 109 can complete a compensating movement within this shaft receiver 5, this being necessary because the shaft 4′ moves about the torsion shafts 102 in an arc when these are fixed in the direction of the ski between the channel 97 and the stops 112 on the binding plate 98. As is shown in the embodiment illustrated in FIGS. 36 to 38, in place of this, the rectangular clip 104 with its torsion shafts 102 can be supported so as to be able to slide within a longitudinal slot 113 in the channel 97 in order that the shaft 4' can be depressed in order to enter the ski binding, or to release it, this is enclosed by a plate 114 that is of hooked cross section and shown by the dashed lines, on the arms 115 of which there are depressions 29 to accommodate a ski pole. This engages between the rib pieces 109 of the ski shoe 9. In order to be able to follow the pivoting movement of the ski shoe 9 this plate 114, which also acts as a snow deflector, is held at its front end by mounded-in pegs 116 in the side supporting slots 117, within which they can also slide in the longitudinal direction of the ski.

As is shown in the embodiment illustrated in FIGS. 36 to 38, there are also in the embodiments shown in FIGS. 39 to 41 two oppositely oriented rectangular clips 46, 118, the torsion shafts 102 of which are, however, fixed in the longitudinal direction of the ski. Since the distance between the shafts 3' and 4' changes when the rectangular clip 101 or the rectangular clips 46, 118 pivot up and down, one of the shaft receivers 5' or 6' of the ski shoe 9 (in the embodiment shown, the rear receiver), has a slot-like cross section, so that the associated shaft 3' can slide within it. In this connection, the shaft receiver 6' can be angled outwards so that when the ski shoe pivots upwards, the shaft 3' encounters a stop. In the extreme positions of this pivoting movement made by the ski shoe 9, as is shown in FIGS. 39 and 40, in each instance one of the shafts 3', 4' of the rectangular clip 46, 118 engages in a transverse groove 121 or 122, respectively, in an elevated portion 119 of the binding plate 120, so that this can then be supported at this point when under load from the ski shoe 9. In addition, this raised portion 119 engages between the two rib pieces 123 that incorporate the shaft receivers 4', 5' and which extend so as to be parallel to each other, so that these contribute to the lateral guidance of the ski shoe 9. In addition, in order to enhance this lateral guidance, the rib pieces 123 are held between the clip arms 101. This embodiment of the present invention, like that shown in FIGS. 36 to 38, is of a particularly flat construction, this being achieved without the need to let any of the binding components into the ski.

Like the embodiment that is shown in FIGS. 33 to 36, the embodiment shown in FIGS. 42 to 44 has only one spring clip 125, although, like the foremost spring clip 118 of the embodiment shown in FIGS. 39 to 41, this is arranged in the reverse direction in front of the ski shoe. In contrast to the plate 114, which serves as an entry aid, an opening in the form of an oblong hole 127 or as a slot is provided in the lug-shaped engagement element 126 which protrudes forward, and the width of this opening is sufficient to accommodate the ski pole 128; its length is calculated so as to provide two engagement positions, these being shown in FIGS. 42 and 43. The limits of the hole in the longitudinal direction, relative to the front shaft 4' in the entry position of the ski shoe, are so arranged as in FIG. 42 and, in its locked position, as in FIG. 43 that the tip of the ski pole or the ski pole 128 is supported laterally on them when pressure is applied to the shaft 4' and thus does not slide away from the shaft 4'. If, by entry into the binding, the shaft 4' is already in the forward part of the shaft receiver 5, a lever effect can be achieved with the ski pole in the space 129 between the shaft 4' and the rear limit 130 of the hole, and this then moves the ski shoe with its shaft 3 rearward relative to the ski, so that the shaft 3 enters into the locking area at the back of the shaft receiver 5 and the front shaft 4' enters into detent into the foremost shaft receiver 6'. Thus, there is no danger that when entering the binding, the ski will slide away. When stepping out of the ski binding the ski shoe can be moved appropriately, i.e., forward, by the lever action of the ski pole 128 in the corresponding front ski pole insertion space 131, so that the shaft 4' once again moves out of the shaft receiver 6'.

In a further development of the embodiment as shown in FIGS. 42 to 44, the embodiment shown in FIGS. 45 to 48 permits the displacement of the ski shoe relative to the ski by means of the ski pole in an additional detent position as shown in the drawing in FIG. 46, i.e., between three positions. For this purpose there are in the engagement portion 126' that projects forward from the ski shoe, two oblong holes 132 and 133 that are staggered relative to each other in the longitudinal direction of the ski, of which the front oblong hole 133 that is shown in FIG. 45 permits unlatching from the shaft receiver 6' and the subsequent displacement by the lever action of the ski pole in a second front shaft receiver 6''. In this front running position of the ski shoe, there is a third shaft 134 as a locking element in the locking position shown in FIG. 46, in which it moves beneath a slot-like recess 135 which is similar to the shaft receiver 5 that has already been described. In this way, the ski shoe is attached to the ski along its whole length, which is a great advantage for the skating step. Thus, the skier can reset the binding for another sort of use during a relatively short stop, without having to step out of the binding, and can do so depending on whether he wishes to use a conventional cross-country step or the skating step. Using this binding, entry and exit to and from the binding is effected by inserting the ski pole into the rear slot 132 in the same manner as has already been described with reference to the oblong hole 127. It is, of course, understood that because of this locking principle it is possible to produce a ski binding which always provides a locking action by means of a rear shaft or an equivalent locking means, which means that it is then possible to dispense with the centre shaft 3.

FIGS. 49 to 50 show an advantageous attachment system that can be used for many kinds of ski bindings. Important in this regard is the fact that it has been possible to dispense with any mounting screws that penetrate directly into the ski. In place of this the binding continues downwards into a longitudinal rib 137 or 138, that is secured in the corresponding groove 139 in the ski. The groove 139 can be formed by a U-profile 140 or 141 that is embedded in the ski during manufacture, the side walls of this profile being suitable for producing a rigid connection with the rib 137 or 138, either, for example, by means of a roughened surface for an adhesive joint corresponding to FIG. 49 or for the insertion of an expander element 142 of an expanding unit 143 that is inserted into the rib 138. To this end, the rib 138 has a plurality of recesses 144 that are spaced one behind the other in the logitudinal direction of the ski, in each of which a spreader element 143 is inserted so that its transverse section 145 is supported below in the recess 144. A threaded hole extends downwards from above in the recesses and this accomodates a spreader screw 146 which forces the inward angled spreader arms 142 outwards so that they engage in the walls of the U-profile 141. In addition, the attachment of the binding to the ski can also be reinforced by means of a plate 147 that is cemented to the upper surface of the ski, this abutting in one piece laterally on the rib 138. The rib 137 or 138 that is inserted into the ski continues in the embodiment shown as a functional part of the binding upwards over the upper surface of the ski, e.g., at the same width, and thus serves to provide lateral support for the ski shoe in that it engages as a guide rib 150 into a longitudinal groove 151 in the sole of the shoe, as is shown, for example, in the embodiments shown in FIGS. 42–44, 45–48, and 51 to 55. A rib 137 or 138 can, however, be provided on each attachment element that is to be secured to the ski in order to permit rapid, precise, and solid installation of the binding.

FIGS. 51 to 55 show a cross-country ski binding that differs from those described heretofor primarily in that the shaft receiver 156 that prevents the transverse twisting of one of two shafts 153, 154 relative to the other shaft receiver 155 is set back, and as a result of the reversal of the arrangement force of the spring works correspondingly on the shaft 153 or the shaft receiver 156, respectively, downwards, towards the ski in order to hold the shoe down on the ski. A special mechanism is provided in order to lock the shaft 153 within the shaft receiver 156 and this is shown as an example in the FIGS. 51–53. This mechanism incorporates two locking slides 158 that are arranged parallel to each other, these being supported in sleeves 159, said sleeves being incorporated in the sole of the shoe. Both slides 158 are connected to each other by means of a stiff wire clip 159 and a portion 160 that projects forward beyond the shoe serves as an operating element for the insertion of the ski pole 128, in order to move the slide 158 against the force of a spring 161 into the release position as shown in FIG. 52. In order to enter this ski binding the locking slides 158 can also be moved back by means of an incline 162, when the shoe with the shaft receiver 156 is pushed onto the shaft 153, which then, in its turn, rests on the guide rib 163 at the point 164. This rib 163 incorporates a somewhat narrower area 165 at the front to engage between the sleeves 159 and at this point has a slot-shaped shaft receiver 155 that runs parallel to the ski and which is open at the front, the task of which corresponds to the task of the shaft receivers 5 or 5', respectively, in the embodiments described heretofor, i.e., to transfer the vertical forces freely from a spring path from the shoe to the ski. It is, of course, understood that it is possible to dispense with the forward shaft connection 154/155 if one can accept an occasional lifting of the shoe from the ski. However, if this lift is excessive, the engagement between the rib 163 and the groove 151 in the shoe will be lost.

FIGS. 56, 57, and 58 show two embodiments of entry aids that supplement, for example, the embodiments shown in FIGS. 1 to 27, by means of which it is made simpler to depress the spring arm 12 when stepping into or out of the binding. In both cases, a depressifon lever 166, 166' is used.

In the version as in FIGS. 56, 57 there is an operating lever 167 which, relative to is pivoting axis 168, is arranged oppositely to the lever 166, so that the spring arm 12 is depressed when the operating lever 167 pivots upwards. A levering movement of the ski pole 128 inserted into the opening 169 can then be advantageous. The operating lever 170 that is arranged on the same side with reference to the pivoting axis 168 to the depression lever 166' is pressed down by the tip of the ski pole in order to depress the spring arm 12 at its end 171. FIGS. 59 to 61 show an embodiment of the invention that corresponds to FIGS. 5 and 6, in which the spring arm 12 is divided into three parallel spring arms **12*a*, 12*b*, and 12*c*, of which the two outermost, as the working springs, are made somewhat stronger than the centre spring arm 12*c*, which serves as a latch tongue on entering into the ski binding. Because of its rounded section 173, its free end forms one half of the shaft receiver 6, of which the other half is formed by the rounded sections 174 at the unattached ends of the working springs 12*a*, 12*b*. An incline 175 on the latch tongue causes this to be deflected when the ski binding is entered because of the pressure of the shaft 4, until this enters into detent in the shaft receiver 6. In this way, when the binding is entered, the working springs 12*a*, 12*b* have to be depressed only slightly so that the desired pretensioning of the spring is achieved. Entry into the ski binding thus requires a slight rearwards movement of the ski shoe 9**.

FIGS. 62 to 73 show two embodiments with a latch tongue 177, 178, arranged so as to be upright and have at their unattached ends an incline 179 that controls their deflection, so that entry into the ski binding takes place by the vertical implantation of the ski shoe 9. This results in a positive engagement between both binding units 1 and 2, which are then locked by means of the latching tongues 177, 178. Both embodiments have an angle piece 181, 182 that can pivot about a shaft 180 that is attached to the ski, the arm 183, 184 of which body that is parallel to the ski having a shaft receiver 185, 186 for a shaft 189 that is provided at the end of a spring clip 188 that depresses it onto the ski. Locking means and the locking tongue mentioned heretofor are disposed on the upwardly oriented arm 190, 191.

In the embodiment shown in FIGS. 62 to 67 there are on the arm 190 two shaft receivers 192, 193 that are arranged one above the other and are open to the top, these being intended to accomodate the shafts 194, 195 that are arranged in a suitable position on the ski shoe 9, or for shaft sections that are on the same axis. It is, of course, understood that the arrangement for the locking engagement can also be reversed, in that the locking element on the arm 190, 191 can be provided on the ski shoe and that of the ski shoe can be provided on the arm 190, 191. On entering the ski binding, the lower shaft 194 of the ski shoe slides on the front side of the arm 190 downwards and into the shaft receiver 192, whereas the upwardly oriented arm 191 is introduced between this shaft and the face surface 196 of the ski shoe. The tip of the locking tongue 177 then moves between the shafts 194, 195 and is then deflected by virtue of its incline 179 into contact with the upper shaft 195, until its hooked portion 197 is seen to engage over the upper shaft 195. FIG. 66 shows the position of the latching tongue 177 that is formed in one piece of plastic with the angle body 181, this being at a greater deflection. After entering completely into detent the face surface 196 of the ski shoe rests against the rear side 198 of the arm 177. In order to open the ski binding, the tip of the ski pole 128 is inserted into the depression 197 at the tip of the latching tongue 177 that is oriented obliquely upwards in order to spring this forward into the release position.

FIGS. 66 and 67 show a variation of the embodiment illustrated in FIGS. 62 to 65, in that here the shaft 189 of the spring clip 188 does not engage in a shaft receiver 185 which is of oblong cross section, but is enclosed on all sides by the shaft receiver 186. In place of this the distance equalization which is required by the pivoting movement of the spring clip 188 is achieved by the sliding support of the spring clip 188 in a guide 199.

However, this equalization of distance is also made possible by the spring shaping of the two arms of the spring clip 188, to which end this can be configured in the shape of an arc, as is indicated by the dashed line 200.

In the embodiment shown in FIGS. 68 to 73, the additional locking shafts 194, 195 have been dispensed with, so that there are only the functional shafts 180 and 189 for movement on the skis. A receiver 201 is provided on the tip of the shoe in order to provide for a positive connection between the binding element 182 that can pivot about the shaft 180 and the ski shoe 9, and this receiver 201 has a vertically oriented receiver space 202 for the upwardly oriented arm 191 of the pivoting binding element 182. This receiver 201 consists preferably of a stiffer material than the body 203 that forms the sole of the shoe, and is, for example, of metal, and is bonded firmly to this by adhesion, vulcanizing, or through, for example, flexible extensions that extend into the body and which are not shown herein. In order to simplify installation of the receiver over the arm 191, the arm 191 and correspondingly the receiver space 202 can be configured so as to taper slightly upwards. The latching tongue 178 is formed on the sprung and pivoting binding element 192 as an arm 191*c*, between the two outer arms 191*a* and 191*b*. On entering the receiver space 202 the latching tongue 178 springs back into the position shown in FIG. 72 because of its upper incline 179 and subsequently enters into detent in the position shown in FIG. 73 with its hook portion over the upper edge 205 of the receiver. The latching tongue can be sprung back into the release position either manually or by inserting the tip of the ski pole into the depression 197 at the tip of the tongue. In order to ensure that the spring movement of the latching tongue 178 is not blocked by ice that penetrates into the receiver space 202 adjacent to the latching tongue, in the upper and centre area of the foremost defining wall 207 of the receiver 201 there is a cutout 208.

In both of the above described embodiments the bearing block 210 for the fixed shaft 180 is enclosed at the sides by parts 181*a*, 181*b*, or 182*a*, 182*b*, respectively that continue upwards into the outer arms 190*a*, 190*b*, or 191*a*, 191*b*, respectively, and are formed in one piece with the longitudinally extended base plate 211 of the ski binding that is cemented onto the ski. However, in place of this, a bearing block can be provided on the edge of the ski in a manner not shown herein, between which the fixed shaft 180 extends. In this regard, both of these bearing blocks for the lateral support of the ski shoe can extend in the manner of ribs, rearwards along the ski edges.

In the embodiment shown in FIGS. 74 to 76 the lateral stability of the ski shoe and its resistance against twisting about its vertical axis can be increased by a particularly large spacing of the anchoring sites in the longitudinal direction of the ski, in that the rear anchoring shaft 212 engages behind the shaft 213 of the spring clip 214 on which the binding unit 215 which is secured to the ski engages.

In this embodiment, too, there is a pivoting binding element 217 that can pivot about a fixed shaft 216 that has an angular longitudinal cross section. The arm of this binding element 217 which, in the normal position as is shown in FIG. 74, is oriented upwards, serves as an operating lever 218 and has an engagement depression 219 in order that it can be depressed to step in or out of the binding in the position shown in FIG. 75. However, when stepping into the binding the binding element 217 can also be pivoted forward by the foremost anchoring shaft 220 of the ski shoe 9. In this position, as shown in FIG. 75, the anchoring shafts 212, 220 can be moved very easily into their associated shaft receivers 221, 222. Because of the pressure of the spring clip 214 that is attached to the coupling arm 223 the binding unit 217 and the coupling arm 223 move back into the position shown in FIG. 74, so that the anchoring shafts 212, 220 are closed around approximately 180° without any free play. If the shaft 213 of the spring clip 214 presses constantly downwards between the anchoring shafts 212, 220 within the shaft receiver 224, the elements that are coupled together in the manner of scissors by means of the rotating shaft 225, i.e., the coupling arm 223 and the rear arm 226 of the pivoting binding element 217, are spread into the extended position shown in FIGS. 74 and 76, in the manner of an articulated lever, so that the anchoring shafts can be held in the shaft receivers 221 and 222 by being pretensioned.

In this embodiment, the spring clip 214, which is of steel wire, but which can also be formed of plastic, has three torsion shafts 228, 229, 230, that are arranged on both sides one behind the other, and by means of which the flexibility of the spring clip is increased. There are many possibilities for the configuration of the spring clip, as is shown, for example, in FIGS. 79 and 80 of an embodiment of the present invention which is comparable to that shown in FIGS. 42 to 44.

In this embodiment as shown in FIGS. 78 to 80, two shafts 233, 234 or 235, 236, respectively are formed by the spring clip 231, 232, in which connection the fixed shaft 234 or 236, respectively, is held in a rib 237, 238 that is secured to the ski, this also serving as the lateral guide for the ski shoe 9 by engagement in a correspondingly formed groove in the sole of the shoe. A housing 239, 239' serves to support the front shaft 240, 240' and the lateral fixing of the spring clip 231, 232, and thus permits the pivoting movement of the spring arms 242*a*, *b* or 243*a*, *b* which is guided in vertical grooves.

FIGS. 81 to 85 show an embodiment of the invention in which, in order to achieve a particularly flat configuration for the binding when it is not in use, a manually operating lever 245 is provided; this is snapped down flat onto the ski prior to stepping into the ski binding or when the skis are carried, as is indicated by the dashed lines in FIG. 81. On stepping into the ski binding the locking shafts 247, 248 that are arranged one behind the other, move beneath the ski shoe 9 into the shaft receivers 249, 250 that are formed by receiver depressions of rectangular cross section in which the spring pivoting binding body 253 is formed. When the locking lever 245 pivots upwards about its shaft 254, which simultaneously forms the axis of pivot of the binding body 253, the rounded end 255 of the locking lever presses against the face surface 256 of the ski shoe and forces this rearwards, so that the locking shafts 247, 248 are fixed vertically and horizontally towards the rear in the U-shaped end area of the shaft receivers 249, 250. In the end position, the flat surface 257 lies on the flat face surface 256 of the ski shoe 9 and in addition, in this locking position, the locking lever 245 engages in the foremost shaft receiver 249. In addition, locating means can be provided, for example, between the locking lever 245 and the ski shoe 9. As is shown by the dashed line at the location 258, additional locking places can be provided further to the rear beneath the ski shoe 9 in order to lock an engagement rib 259 that extends rearwards from the binding element 253 onto the ski shoe 9. The mutual engagement at the locking places can also be achieved without using shafts, by using means that operate in a similar manner, such as serrations or inter-hooking, or the like. In the event that the rib 259 extends continuously as far as the heel of the ski shoe in the engagement between the locking shafts 247, 248 and the shaft receivers 249, 250 that is shown herein, locking can also take place at the heel of the shoe by means of fastening means that overlap this, and which can be unlocked either by means of the ski pole or by hand. A base rib 261 which is of triangular cross section can be formed on the base plate 260 to provide engagement on the ski and this then engages in a groove 262 of the rib 259.

The embodiment that is shown in FIGS. 81 to 85 also shows that, unlike the embodiments in FIGS. 62 to 73, the flat spring clip can be arranged in front of the ski shoe 9 instead of beneath it.

The embodiment shown in FIGS. 86 to 89 bears a functional similarity with the embodiments shown in FIGS. 62 to 73, although with the important difference that a separate clip-shaped locking spring 265 is provided, which brings this into detent in a U-shaped recess 267 that is open at the bottom on the projecting portion 268 of the tip of the shoe by means of an upwardly acting force on its detent shaft 266. At this point it can be operated by means of the ski pole 128 through the recess 269 in part 268, which is open at the top, in a manner similar to that shown in the embodiment illustrated in FIGS. 42, 43. As is shown in FIGS. 88 and 89, the detent shaft 266 is held in two guides 270 which are closed at the top, by means of two side blocks 271, 272, between which the front part 268 of the ski shoe 9 is supported. In addition, the blocks 271, 272 hold the tip of the shoe on the binding element 274 that can pivot flexibly about the shaft 273 in a vertical direction, in that side ribs 275 are inserted into the horizontal slot 276 at the lower end of the guides 270, and these simultaneously serve in the assembly of the clip-shaped detent spring 265. On being slid in, which can be done by the ski pole on the detent shaft 266, a locking shaft 277 that is provided beneath the ski shoe 9 moves into a shaft receiver 278 that is open to the rear and is located at the rear end of the binding element 274. The spring clip 279 that forms the movement spring can be attached in this embodiment too, either in front of or behind the pivoting binding body 274, on the base plate 280 of the ski binding, in order that its shaft holds the binding body 247 under tension flexibly on the base plate 280, i.e., the ski.

The preceding description shows that according to the basic principle of the invention there are numerous possible embodiments of the present invention although these can only be indicated schematically and not in a complete manner. The application of a spring force that is at least approximately perpendicular to the ski or to the ski shoe, either directly or through an intermediate body, to at least one shaft that is securely held in a shaft receiver or supported therein, permits a relatively great spring travel and a freer configuration of spring elements in a flat construction in order to achieve the optimum distribution of the spring force over the whole of its path. The spring shafts or shaft receivers permit numerous advantageous embodiments for releasable insertion or engagement means, in order to ensure easy entry into the binding and exit from it. In this connection, the use of spiral springs, as has been mainly shown herein, has proven to be particularly advantageous, the shafts or the shaft receivers being located at the unattached ends of said springs. The arrangement of the shafts one behind the other in the longitudinal direction of the ski, connected by a spring force that acts perpendicularly to the ski, also imparts improved stability against twisting about a vertical axis to the ski shoe. It is of course understood that, with regard to its action, the expression shaft is also to be understood to include a similarly oriented geometrical axis, for a plurality of spaced shaft sections can form an effective shaft if they are all on the same axis.

In order to avoid the fact that a large range of shoe sizes for all foot sizes has to be provided for the various binding units 1 that are secured to the ski, in a further configuration of the invention the binding unit 2' that is secured to the shoe is not attached to the shoe permanently, but is secured to it releasably as an adaptor. This simplifies the variation between the numerous above described embodiments of a ski binding according to the present invention. FIGS. 90 and 95 to 97 show examples for binding adaptors that permit the use of different first binding units 1 according to the above described embodiments with the same ski shoe 9'' of a known configuration.

Binding adaptors 283 to 286 are matched on the side which faces the ski shoe 9'' to the contour of the shoe so as to provide a positive fit and in addition have a receiver slot 287 for the shaft clip 288 which is matched to these so as to form a positive fit, as is indicated by the dashed line in FIG. 91. In the assembled state as shown in FIG. 94, two screw shafts 289, 290 are located behind the shaft clip 288 within both its angular ranges so as to provide a solid contact, and these are screwed through threaded holes 291 that extend transversely through the receiver slot 287.

I claim:

1. A ski binding for cross-country skis, said binding comprising:

a first binding unit that is permanently attached to the ski;

a second binding unit that forms a part of a ski shoe;

two parallel shafts;

a fixed shaft receiver associated with one said shaft;

a second shaft receiver associated with the other said shaft;

at least one spring element;

said fixed shaft receiver holding it's associated shaft in a direction perpendicular to a major axis of the ski, the two shafts and their associated shaft receivers both connecting the binding units to each other and spaced from each other in the longitudinal direction of the ski and at least one of the shafts being loaded by said at least one spring element in a direction at least approximately perpendicular to the ski when the ski shoe is set on the ski.

2. A ski binding as defined in claim 1 wherein the two shafts and their associated shaft receivers are distributed in the proportion of 2:2 on each each binding units.

3. A ski binding as defined in claim 1 wherein when the ski shoe is set on the ski the shaft receivers have a U-shaped cross section that is open on one side for the associated shaft and the U-shaped cross section of the two shaft receivers are arranged at least approximately at a right angle relative to each other.

4. A ski binding as defined in claim 1 wherein said spring element is comprised of a flexibly elastic arm, said arm having a free end, one of said shafts disposed on said free end.

5. A ski binding as defined in claim 1 further comprising a pivotably supported lever, said lever having a free end, one of said shaft receivers disposed on said free end, and said spring element loads said lever.

6. A ski binding as defined in claim 4 wherein the flexibly elastic arm are comprised of a wire clip in which connection a cross piece of the wire clip forms one of the shafts and at least one portion of the wire clip that is arranged parallel to the shaft is a torsion bar.

7. A ski binding as defined in claim 1 wherein a part of the first binding unit is let into the ski and there secured.

8. A ski binding as defined in claim 1 wherein said at least one spring element is arranged beneath the ski shoe.

9. A ski binding as defined in claim 1 further comprising a locking system provided behind a toe of the shoe beneath the ski shoe.

10. A ski binding as defined in claim 1 wherein said spring element is comprised of a flexibly elastic arm, said arm having a free end, one of said shaft receivers disposed on said free end.

11. A ski binding unit for cross country ski, said binding comprising:

a first binding unit attached to the ski;

a second binding unit that forms a part of a ski shoe;

a first shaft disposed upon one of said binding units;

a first shaft receiver disposed upon the other of said binding units, said first shaft receiver including means for retaining said first parallel shaft in a direction lateral to a major longitudinal axis of said ski;

a second shaft disposed upon one of said binding units;

said first shaft being parallel to said second shaft;

a second shaft receiver disposed upon the other of said binding units;

means for restraining said second shaft in said second shaft receiver so that the ski shoe is held flat on the ski, said second shaft receiver restraining said second shaft in a position spaced along the longitudinal axis of said ski from where said first shaft receiver retains first shaft.

12. A ski binding as claimed in claim 11 wherein the two shafts their associated shaft receivers are distributed in the proportion of 2:2 on each said binding unit.

13. A ski binding as claimed in claim 11 wherein the two shaft receivers have a U-shaped cross section, said U-shaped cross section of the two shaft receivers being arranged at least approximately at a right angle relative to each other.

14. A ski binding as claimed in claim 11 wherein said restraining means comprises an elastic arm, said arm having a free end, one of said shafts disposed on said free end.

15. A ski binding as claimed in claim 14 wherein the elastic arm is comprised of a wire clip, said wire clip having a cross piece that forms one of said shafts and at least one portion of said wire clip that is arranged parallel to said shaft comprises a torsion bar.

16. A ski binding as claimed in claim 11 wherein said restraining means comprises an elastic arm, said arm having a free end, one of said shaft receivers disposed on said free end.

17. A ski binding as claimed in claim 11 wherein a portion of said first binding unit is adapted to be embedded into and secured to the ski.

18. A ski binding as claimed in claim 17 wherein said portion of said first binding unit is a rib securing said first binding unit to the ski.

19. A ski binding as claimed in claim 17 wherein said portion of said first binding unit comprises said restraining means.

20. A ski binding as claimed in claim 11 wherein said restraining means is located beneath the ski shoe.

21. A ski binding as claimed in claim 11 wherein the ski shoe has a toe portion, a selected one of said shafts is located longitudinally in front of the toe portion of the ski shoe and the other of said shafts is located below the ski shoe.

22. A ski binding as claimed in claim 11 further comprising a locking mechanism to lock one of said shafts within its associated shaft receiver.

23. A ski binding as claimed in claim 22 wherein said locking mechanism is located behind a toe of the shoe beneath the ski shoe.

24. A ski binding as claimed in claim 1 wherein at least one of said parallel shafts is loaded through a moveably held intermediate member in a direction that is at least approximately perpendicular to the ski, indirectly by said at least one spring element.

25. A ski binding as claimed in claim 4 wherein said flexibly elastic arm is formed in one piece of plastic with a binding plate for attaching said first binding unit to the ski.

26. A ski binding as claimed in claim 1 wherein said second binding unit can be connected to said first binding unit in two positions that are one behind the other in longitudinal direction of the ski, one of said positions being in a locking system provided beneath the ski shoe in the locked position, in which the ski shoe is secured to the ski through the whole length of the shoe.

27. A ski binding as claimed in claim 24 further comprising a second element pivotably located about said shaft that is fixed to the ski.

28. A ski binding as claimed in claim 1 wherein said second binding unit is locked with said first binding unit by means of a second spring element.

* * * * *